US011255039B2

(12) United States Patent
Jung et al.

(10) Patent No.: US 11,255,039 B2
(45) Date of Patent: Feb. 22, 2022

(54) WASHING MACHINE

(71) Applicant: LG Electronics Inc., Seoul (KR)

(72) Inventors: Hwanjin Jung, Seoul (KR); Myunghun Im, Seoul (KR); Junghoon Lee, Seoul (KR); Kyungchul Woo, Seoul (KR); Hyundong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 65 days.

(21) Appl. No.: 16/474,981

(22) PCT Filed: Dec. 28, 2017

(86) PCT No.: PCT/KR2017/015626
§ 371 (c)(1),
(2) Date: Jun. 28, 2019

(87) PCT Pub. No.: WO2018/124762
PCT Pub. Date: Jul. 5, 2018

(65) Prior Publication Data

US 2019/0330780 A1 Oct. 31, 2019

(30) Foreign Application Priority Data

Dec. 28, 2016 (KR) ..... 10-2016-0180853
Dec. 28, 2016 (KR) ..... 10-2016-0180854
(Continued)

(51) Int. Cl.
*D06F 33/00* (2020.01)
*D06F 37/06* (2006.01)
(Continued)

(52) U.S. Cl.
CPC ..... *D06F 39/08* (2013.01); *D06F 33/00* (2013.01); *D06F 37/06* (2013.01); *D06F 37/22* (2013.01);
(Continued)

(58) Field of Classification Search
USPC ..... 68/12.01, 17 R, 139, 142, 207
See application file for complete search history.

(56) References Cited

U.S. PATENT DOCUMENTS

2009/0249840 A1 10/2009 Jo et al.
2014/0311189 A1* 10/2014 Im ..... D06F 39/08 68/12.01

FOREIGN PATENT DOCUMENTS

CN 102121186 7/2011
CN 102575412 7/2012
(Continued)

OTHER PUBLICATIONS

Extended European Search Report in European Application No. 17885826.2, dated May 15, 2020, 6 pages.
(Continued)

*Primary Examiner* — Levon J Shahinian
(74) *Attorney, Agent, or Firm* — Fish & Richardson P.C.

(57) ABSTRACT

A washing machine includes: a casing, a tub, a drum, a cylindrical gasket connecting an input port of the casing to an opening of the tub, a pump configured to circulate water discharged from the tub; a guide pipe fixed to the gasket configured to guide water supplied from the pump, and nozzles configured to spray water from the guide pipe into the drum. The nozzles include an upper nozzle configured to spray water downward, intermediate nozzles disposed below the upper nozzle in both left and right sides and configured to spray water downward while spraying water deeper into the drum than the upper nozzle, and lower nozzles disposed
(Continued)

above the inflow port, disposed below the intermediate nozzles in both left and right sides based on the inflow port and configured to spray water upward.

31 Claims, 30 Drawing Sheets

(30) Foreign Application Priority Data

| | | |
|---|---|---|
| Dec. 28, 2016 | (KR) | 10-2016-0180855 |
| Dec. 28, 2016 | (KR) | 10-2016-0180856 |
| Dec. 28, 2016 | (KR) | 10-2016-0180857 |
| Dec. 28, 2016 | (KR) | 10-2016-0180858 |
| Jan. 6, 2017 | (KR) | 10-2017-0068595 |
| Jun. 28, 2017 | (KR) | 10-2017-0082007 |
| Jun. 28, 2017 | (KR) | 10-2017-0082009 |

(51) Int. Cl.

| | |
|---|---|
| ***D06F 37/22*** | (2006.01) |
| ***D06F 37/26*** | (2006.01) |
| ***D06F 37/30*** | (2020.01) |
| ***D06F 39/08*** | (2006.01) |
| ***D06F 39/12*** | (2006.01) |

(52) U.S. Cl.

CPC ..... *D06F 37/266* (2013.01); *D06F 37/30* (2013.01); *D06F 39/12* (2013.01); *D06F 39/083* (2013.01)

(56) References Cited

FOREIGN PATENT DOCUMENTS

| | | |
|---|---|---|
| CN | 103547726 | 1/2014 |
| CN | 104631060 | 5/2015 |
| EP | 2602381 | 6/2013 |
| EP | 2719841 | 4/2014 |
| JP | 2011056113 | 3/2011 |
| JP | 2011250922 | 12/2011 |
| JP | 2014004276 | 1/2014 |
| KR | 1020130048445 | 5/2013 |
| KR | 101461390 | 11/2014 |
| KR | 101593001 | 2/2016 |
| KR | 1020160119045 | 10/2016 |
| KR | 101708666 | 2/2017 |
| WO | WO2014037840 | 3/2014 |

OTHER PUBLICATIONS

Chinese Office Action in Chinese Appln. No. 201780087574.9, dated Nov. 3, 2020, 13 pages, (with English translation).

KR Office Action in Korean Appln. No. 10-2017-0082009, dated Jun. 16, 2021, 10 pages (with English translation).

* cited by examiner

WASHING MACHINE

CROSS-REFERENCE TO RELATED APPLICATIONS

This application is a National Stage application under 35 U.S.C. § 371 of International Application No. PCT/KR2017/015626, filed on Dec. 28, 2017, which claims the benefit of Korean Application No. 10-2017-0082007, filed on Jun. 28, 2017, Korean Application No. 10-2017-0082009, filed on Jun. 28, 2017, Korean Application No. 10-2017-0068595, filed on Jun. 1, 2017, Korean Application No. 10-2016-0180858, filed on Dec. 28, 2016, Korean Application No. 10-2016-0180857, filed on Dec. 28, 2016, Korean Application No. 10-2016-0180856, filed on Dec. 28, 2016, Korean Application No. 10-2016-0180855, filed on Dec. 28, 2016, Korean Application No. 10-2016-0180854, filed on Dec. 28, 2016, and Korean Application No. 10-2016-0180853, filed on Dec. 28, 2016. The disclosures of the prior applications are incorporated by reference in their entirety.

TECHNICAL FIELD

The present invention relates to a washing machine having a nozzle for discharging water, which is discharged from a tub and circulated along a circulation pipe, into a drum.

BACKGROUND ART

Generally, a washing machine is an apparatus that separates contaminants from clothing, bedding, and the like (hereinafter, referred to as "laundry") by using a chemical decomposition of water and detergent and a physical action such as friction between water and laundry.

Such a washing machine includes a tub containing water and a drum rotatably installed in the tub to receive the laundry. A recent washing machine is configured to circulate water discharged from the tub by using a circulation pump, and to spray the circulated water into the drum through a nozzle. However, since such a conventional washing machine usually includes a single or two nozzles, the direction of spraying through a nozzle is restricted, and thus the laundry cannot not be wet evenly.

In particular, in recent years, although new technologies for controlling the rotation of the drum have been developed in order to impart variety to the flow of laundry put into the drum, there is a limit in that a remarkable improvement in performance cannot be expected with a conventional structure.

DISCLOSURE

Technical Problem

The present invention has been made in view of the above problems, and provides, first, a washing machine in which water discharged from a tub is sprayed into the drum at three or more different heights.

Second, the present invention further provides a washing machine in which water discharged from the tub is guided through a single common flow path, and the water guided through the flow path is sprayed through nozzles disposed at different heights on the flow path.

Third, the present invention further provides a washing machine in which the flow path and the three or more nozzles are provided in a gasket.

Fourth, the present invention further provides a washing machine capable of varying the flow rate (or water pressure) of water sprayed through the nozzles.

Fifth, the water sprayed through the nozzle can reach the deep position of the inside of the drum.

Sixth, even if permeation washing is performed in a state in which a large amount of cloth is put in, the water sprayed from the nozzle can evenly wet the cloth.

Technical Solution

In an aspect, there is provided a washing machine comprising: a casing having an input port, which is formed on a front surface of the casing, for inputting laundry; a tub which is disposed in the casing and contains washing water, and has an opened front surface communicating with the input port; a drum which is rotatably disposed in the tub, and contains the laundry; a cylindrical gasket which communicates the input port with an opening of the tub; a pump which sends water discharged from the tub; a guide pipe which is fixed to the gasket, and forms an annular flow path for guiding water supplied from the pump; and a plurality of nozzles which spray water supplied through the guide pipe into the drum, wherein the plurality of nozzles comprises: an upper nozzle which spray water downward; a pair of intermediate nozzles which are disposed below the upper nozzle, disposed in both left and right sides based on an inflow port of the guide pipe into which the water supplied by the pump flows, and spray water downward while spraying water deeper into the drum than the upper nozzle; and a pair of lower nozzles disposed above the inflow port, disposed below the intermediate nozzle, and disposed in both left and right sides based on the inflow port, and spray water upward.

The guide pipe is fixed to an inner circumferential surface of the gasket, wherein the plurality of nozzles are integrally formed with the guide pipe.

The gasket comprises: a casing coupling unit coupled to a circumference of the input port; a tub coupling unit coupled to a circumference of the opening of the tub; a flat portion extending evenly from the casing coupling unit toward the tub coupling unit; and a folded unit which is formed between the flat portion and the tub coupling unit, and folded in correspondence with displacement of the tub, wherein the guide pipe is disposed in the flat portion.

The gasket is protruded outward from the flat portion so that an accommodating groove is formed on an inner circumferential surface of the flat portion, and at least a part of the guide pipe is accommodated in the accommodating groove.

The washing machine further comprises a connection pipe which extends outwardly from the inflow port of the guide pipe and pass through the gasket and connected to a circulation pipe for guiding water sent by the pump in the outside of the gasket, and the accommodating groove is formed in an upper area excluding a certain lower area defined by including a point through which the connection pipe passes.

The gasket further comprises a cylindrical accommodating portion which is protruded from the inner circumferential surface of the flat portion and extends along a circumference, and at least a part of the guide pipe is accommodated in the accommodating portion.

The washing machine of claim 6, wherein the guide pipe and the accommodating portion are integrally formed by insert injection.

The guide pipe is fixed on an outer circumferential surface of the gasket, and the plurality of nozzles are disposed to penetrate the gasket, and are connected to the guide pipe in the outside of the gasket The pair of intermediate nozzles are disposed above a center of the guide pipe.

The pair of intermediate nozzles are symmetrically formed.

The pair of lower nozzles are disposed below a center of the guide pipe.

The pair of lower nozzles are symmetrically formed.

Each of the plurality of nozzles comprises: an opening forming surface having an opening through which water is introduced through the guide pipe; and a collision surface for guiding the water which is discharged through the opening to progress to an outlet that is opened toward the drum, after the water collides with the collision surface, and an angle formed by the opening forming surface and the collision surface becomes smaller in order of the upper nozzle, the intermediate nozzle, and the lower nozzle.

The inflow port is disposed in a lowermost point of the guide pipe.

The plurality of nozzles are integrally formed with the guide pipe.

The pump is able to accomplish a speed control.

The plurality of nozzles are formed in the gasket, and the guide pipe is embedded in the gasket.

The gasket comprises: a casing coupling unit coupled to a circumference of the input port of the casing; a tub coupling unit coupled to a circumference of the opening of the tub; an extension unit extending from between the casing coupling unit and the tub coupling unit; and a guide pipe accommodating unit which is protruded outwardly from the extension unit, and accommodates the guide pipe therein.

The extension unit comprises: a flat portion extending evenly from the casing coupling unit toward the tub coupling unit; and a folded unit which is formed between the flat portion and the tub coupling unit, and folded in correspondence with displacement of the tub, and the folded unit comprises: an inner diameter portion bent from the flat portion toward the casing coupling unit; and an outer diameter portion bent from the inner diameter portion toward the tub coupling unit side, and the guide pipe accommodating unit is formed in the outer diameter portion.

The guide pipe comprises a plurality of nozzle water supply ports which are protruded inwardly along a radial direction from the annular flow path, in correspondence with the plurality of nozzles respectively, wherein, in the gasket, a plurality of port insertion pipes which are protruded from an inner circumferential surface of the outer diameter portion, have one end communicating with the guide pipe accommodating unit, and have the other end connected with a corresponding nozzle are formed, and the nozzle water supply port is inserted into each of the port insertion pipes.

The washing machine further comprises a circulation pipe for guiding water sent by the pump, and the guide pipe further comprises a circulation pipe connection port which has one end in which the inflow port is formed, is protruded from the one end and passes through the gasket and is connected to the circulation pipe.

The guide pipe further comprises at least one fixing pin which is protruded from an outer circumferential surface of the annular flow path and passes through the gasket and is protruded outside the gasket.

The at least one fixing pin is formed in an upper end, a left end, and a right end of the annular flow path respectively.

The pair of intermediate nozzles are disposed above a center of the annular flow path.

The pair of intermediate nozzles are symmetrically formed.

The pair of lower nozzles are disposed below a center of the annular flow path.

The pair of lower nozzles are symmetrically formed.

Each of the plurality of nozzles comprises: a collision surface for guiding the water which is discharged from the guide pipe to progress to an outlet of the nozzle which is opened toward the drum, after the water collides with the collision surface, The inflow port is connected to a lowermost point of the annular flow path.

The pump is able to accomplish a speed control.

The guide pipe and the gasket are integrally formed by insert molding.

Advantageous Effects

In the washing machine of the present invention, first, an annular guide pipe for guiding circulating water to be sprayed into the drum is installed in a gasket, and the guide pipe is firmly fixed to the gasket, so that even if vibration is generated due to rotation of a drum, there is an effect that the guide pipe is not easily separated from the gasket.

Second, the water discharged from a tub is sprayed into the drum in various directions at three or more different heights, so that three-dimensional washing can be accomplished.

Third, since the water discharged from the tub is guided to a plurality of nozzles through a single common flow path, the flow path structure is simplified.

Fourth, by forming the common flow path in an annular shape, it is easy to install in the gasket.

Fifth, by supplying water to the nozzles by using a pump capable of controlling the flow rate (or the speed, the number of revolutions), there is an effect that the flow rate, the pressure (or intensity) of the water sprayed through the nozzles, or the range which the sprayed water can reach can be varied.

Sixth, there is an effect that the water sprayed through the nozzle can reach the deep position of the inside of the drum in comparison with the conventional art.

Seventh, even if permeation washing is performed in a state in which a large amount of laundry is put in, the water sprayed from the nozzles can effectively wet the laundry.

MODE FOR INVENTION

Figure 1:
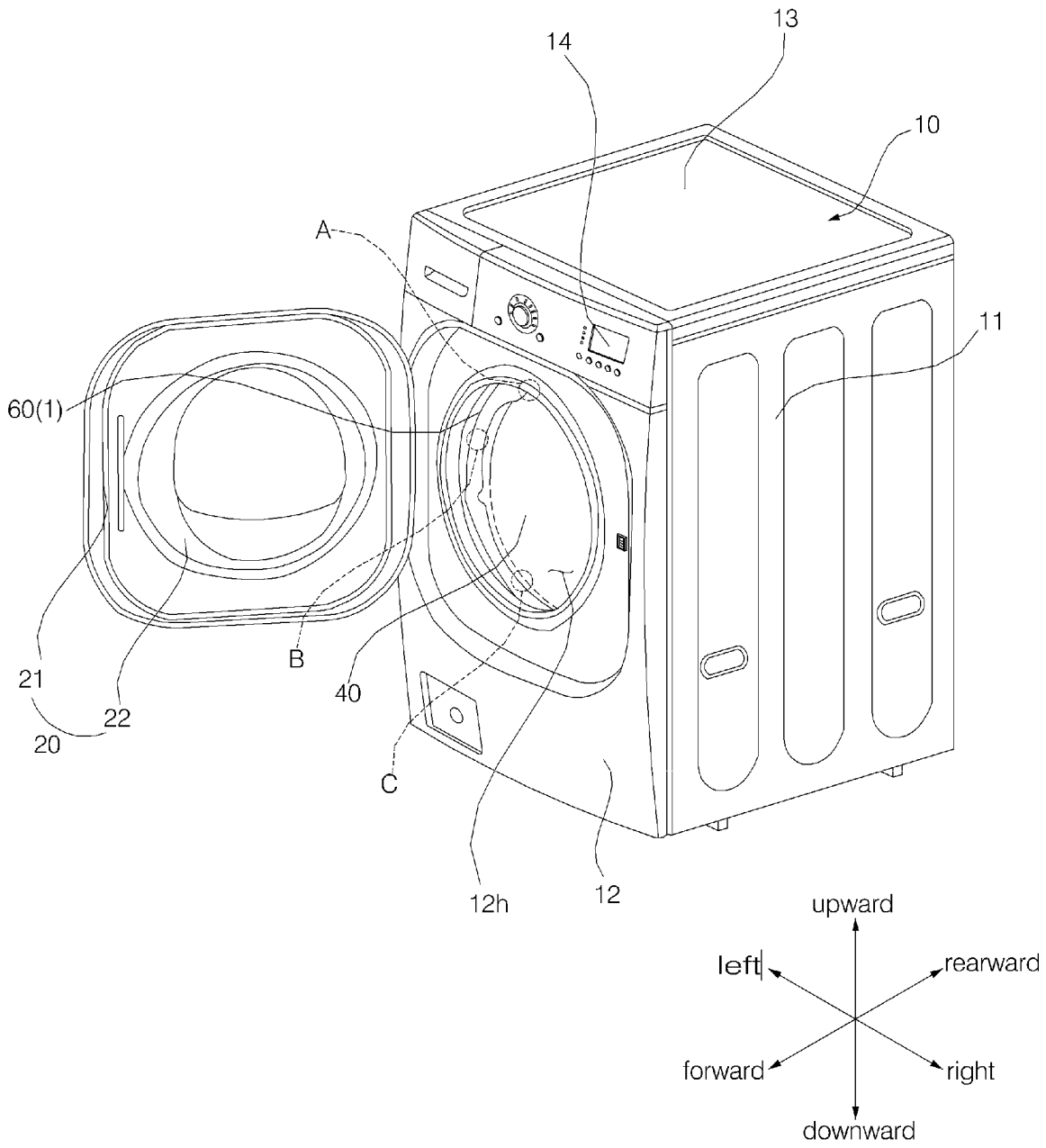
FIG. 1 is a perspective view showing a washing machine according to an embodiment of the present invention.
Figure 2:
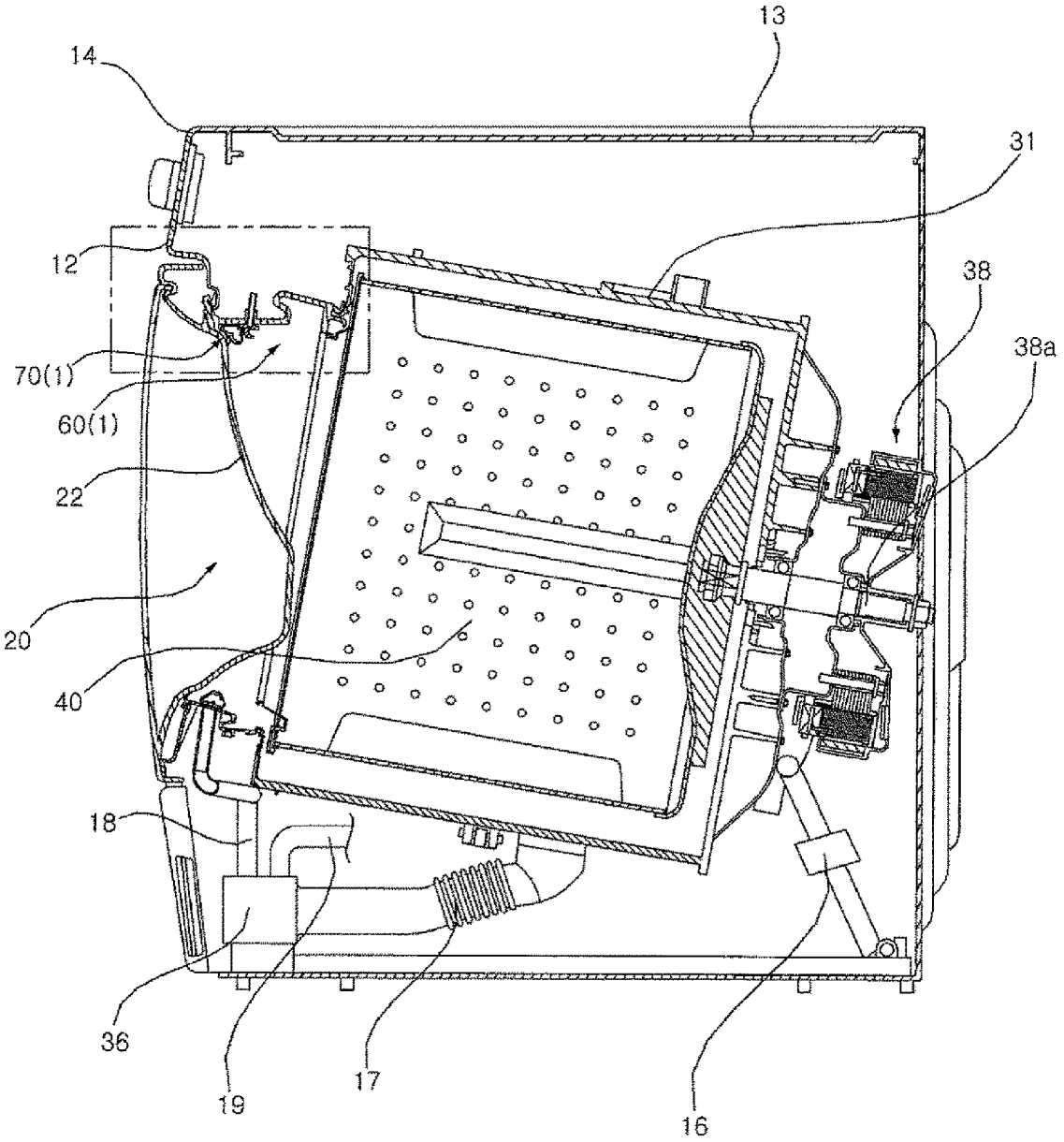
FIG. 2 is a cross sectional view of the washing machine shown in FIG. 1.
Figure 3:
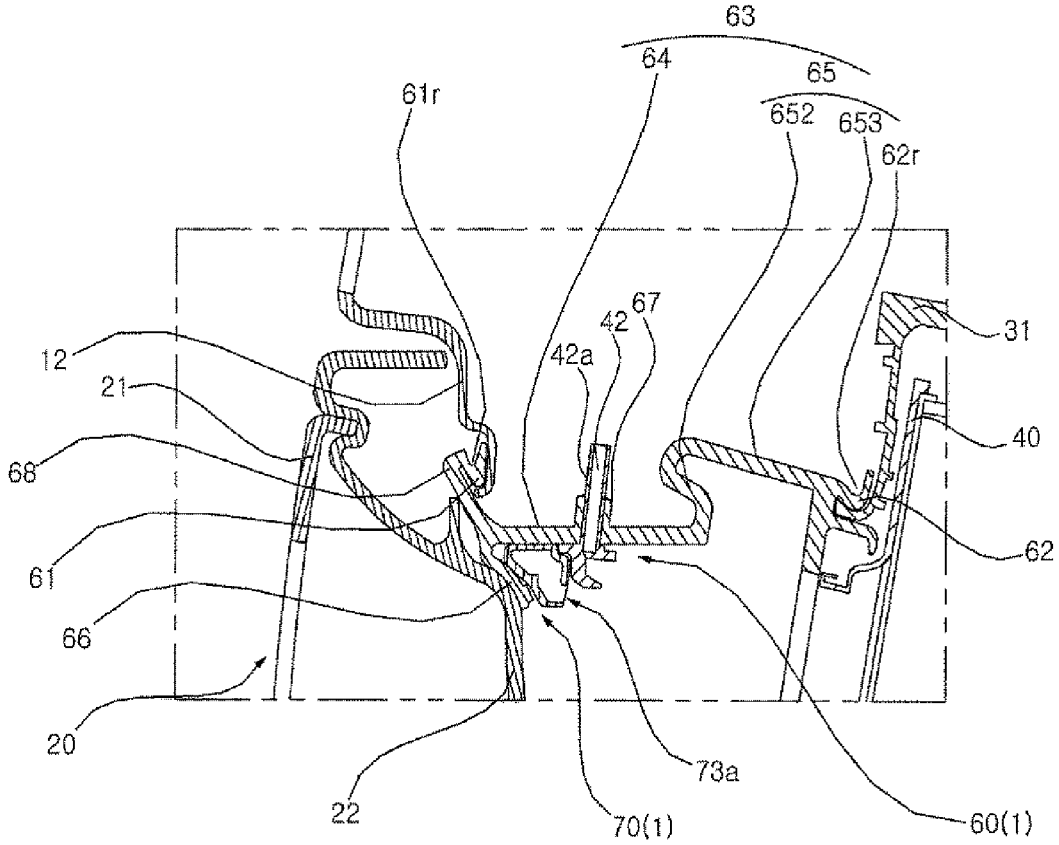
FIG. 3 is an enlarged view of a portion indicated by a dotted line in FIG. 2.
Figure 4:
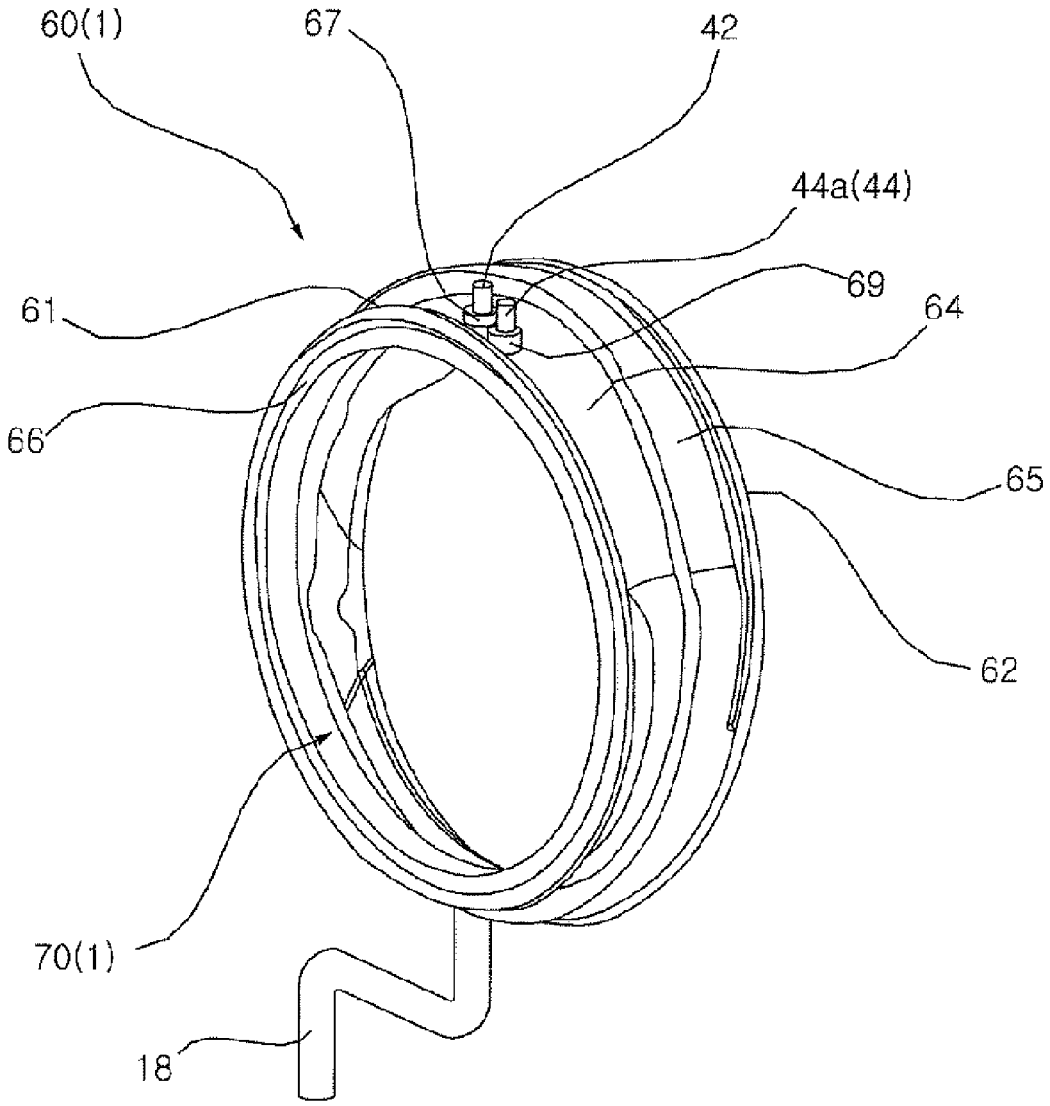
FIG. 4 shows an assembly including a gasket and a circulating water spraying apparatus.
Figure 5:
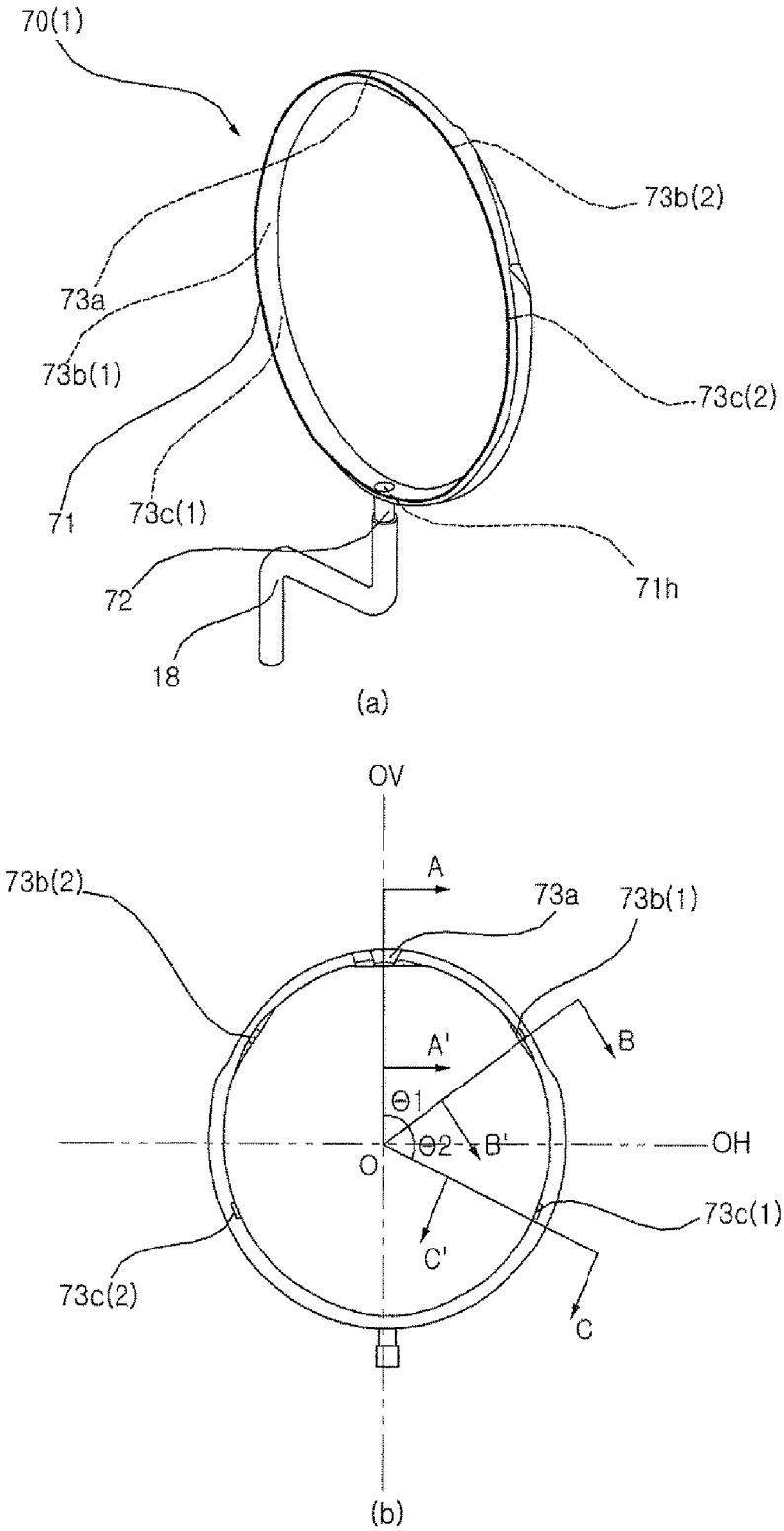
FIG. 5 shows the circulating water spraying apparatus shown in FIG. 4.
Figure 6:
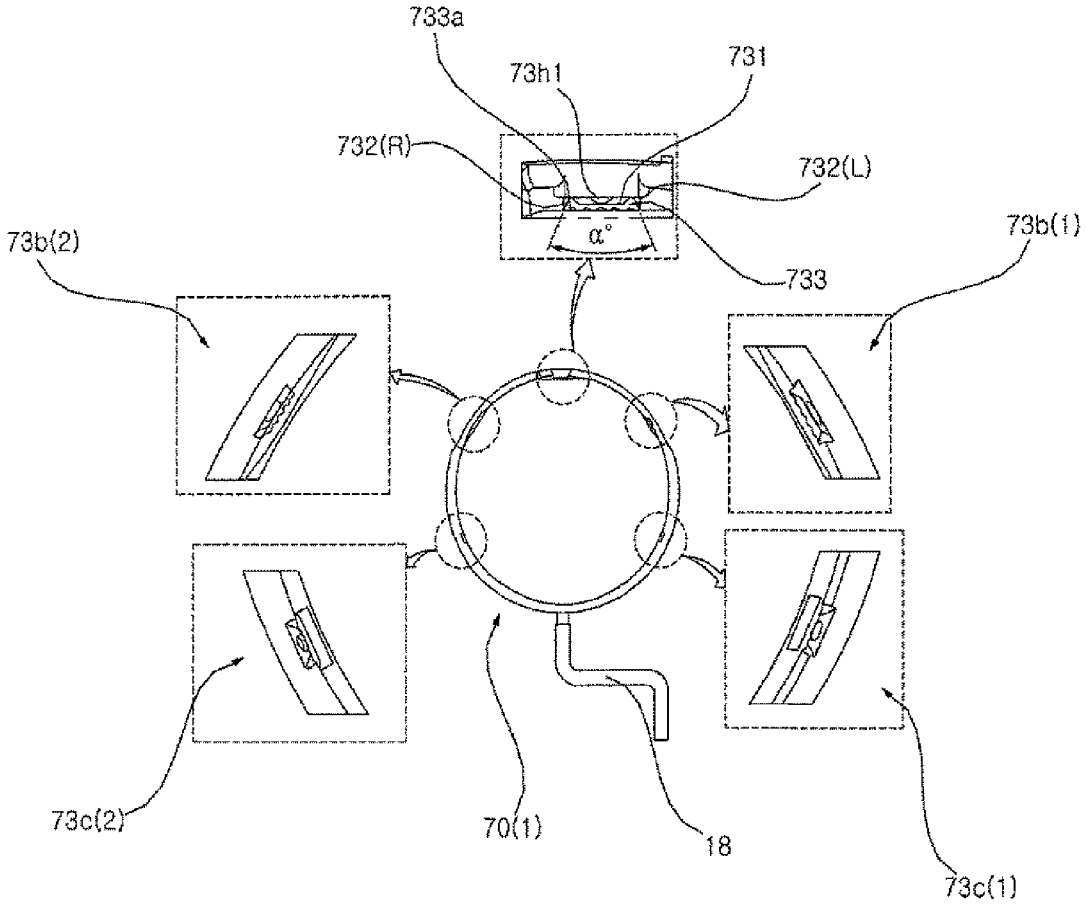
FIG. 6 shows a guide pipe and an enlarged view of nozzles formed thereon.
Figure 7:
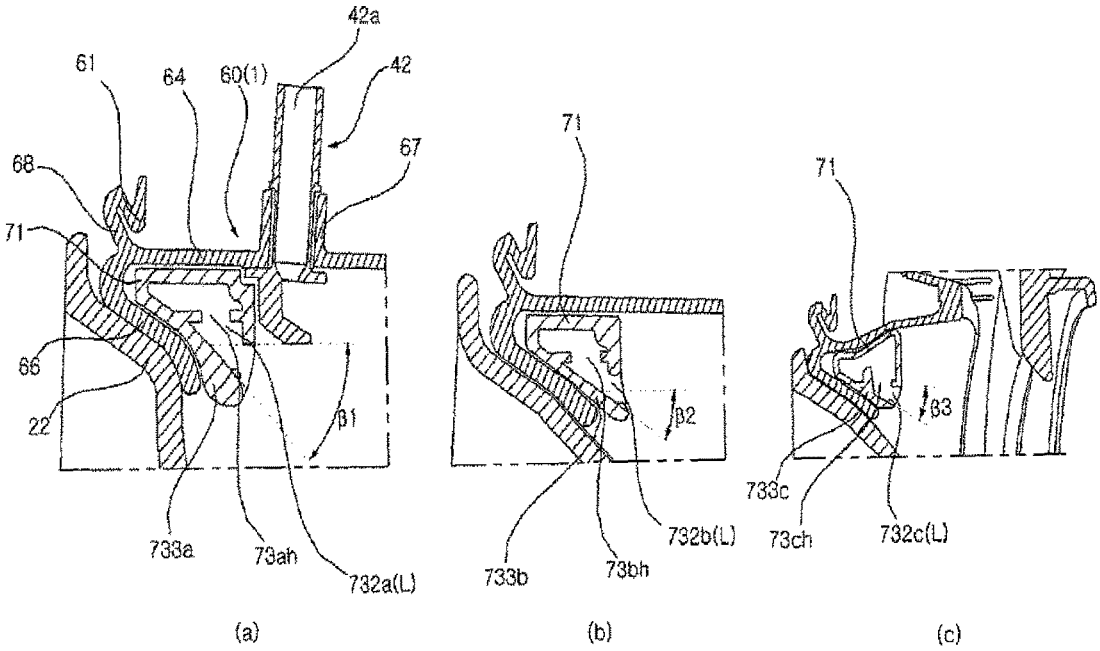
FIG. 7 shows a structure in which nozzles are installed in a gasket, FIG. 7(*a*) shows an upper nozzle cut along the line A-A' in FIG. 5, FIG. 7(*b*) shows an intermediate nozzle cut along the line B-B' in FIG. 5, and FIG. 7(*c*) shows a lower nozzle cut along the line C-C' in FIG. 5.

FIG. 1 is a perspective view showing a washing machine according to an embodiment of the present invention. FIG. 2 is a cross sectional view of the washing machine shown in FIG. 1. FIG. 3 is an enlarged view of a portion indicated by a dotted line in FIG. 2. FIG. 4 shows an assembly including a gasket and a circulating water spraying apparatus. FIG. 5 shows the circulating water spraying apparatus shown in FIG. 4. FIG. 6 shows a guide pipe and an enlarged view of nozzles formed thereon. FIG. 7 shows a structure in which nozzles are installed in a gasket, FIG. 7(*a*) shows an upper nozzle cut along the line A-A' in FIG. 5, FIG. 7(*b*) shows an intermediate nozzle cut along the line B-B' in FIG. 5, and FIG. 7(*c*) shows a lower nozzle cut along the line C-C' in FIG. 5. Hereinafter, a washing machine according to an embodiment of the present invention will be described with reference to FIG. 1 to FIG. 7.

Referring to FIGS. 1 and 2, a casing 10 forms an outer appearance of the washing machine, and an input port 12*h* through which laundry is inputted is formed on the front surface thereof. The casing 10 may include a cabinet 11 that has a front surface which is opened and has a left surface, a right surface, and a rear surface, and a front panel 12 that is coupled to the opened front surface of the cabinet 11 and has the input port 12*h*. A bottom surface and an upper surface of the cabinet 11 are opened, and a horizontal base 15 supporting the washing machine may be coupled to the bottom surface. In addition, the casing 10 may further include a top plate 13 covering an open top surface of the cabinet 11, and a control panel 14 which is disposed in the upper side of the front panel 12 and configures a part of the front surface of the casing 10.

In the casing 10, a tub 31 containing water may be disposed. The tub 31 is provided with an opening at the front thereof so that the laundry can be input, and the opening is communicated with the input port 12*h* formed in the casing 10 by the gasket 60(1).

A door 20 for opening and closing the input port 12*h* may be rotatably coupled to the casing 10. The door 20 may include a door frame 21 which is opened at a substantially central portion and is rotatably coupled to the front panel 12 and a window 22 provided at the opened central portion of the door frame 21.

The gasket 60(1) serves to prevent the water contained in the tub 31 from leaking. The front end portion thereof is coupled to the front surface (or the front panel 12) of the casing 10, the rear end portion thereof is coupled to a circumference of the opening of the tub 31, and a portion between the front end portion and the rear end portion extend in a cylindrical shape. The gasket 60(1) may be made of a flexible or resilient material. The gasket 60(1) may be made of natural rubber or synthetic resin.

Referring to FIG. 3, the gasket 60(1) may include a casing coupling unit 61 coupled to a circumference of the input port 12*h* of the casing 10, a tub coupling unit 62 coupled to the circumference of the opening of the tub 31, and an extension unit 63 extending from the casing coupling unit 61 to the tub coupling unit 62.

In the front panel 12, the circumference of the input port 12*h* is curled outward, and the casing coupling unit 61 is inserted into the concave portion formed by the outer circumferential surface of the curled portion.

The casing coupling unit 61 is provided with an annular groove 61*r* in which a wire is wound, and both ends of the wire are bound after the wire is wound along the groove 61*r* so that the casing coupling unit 61 is firmly fixed around the input port 12*h*.

In the tub 31, the circumference of the opening is curled outward, and the tub coupling unit 62 is inserted into the concave portion formed by the outer circumferential surface of the curled portion. The tub coupling unit 62 is provided with an annular groove 62*r* in which a wire is wound, and both ends of the wire are bound after the wire is wound along the groove 62*r* so that the tub coupling unit 62 is firmly coupled around the opening of tub 31.

Meanwhile, the casing coupling unit 61 is fixed to the front panel 12, but the tub coupling unit 62 is displaced according to the movement of the tub 31. Therefore, the extension unit 63 should be able to be deformed in response to the displacement of the tub coupling unit 62.

In order to smoothly achieve such a deformation, in the gasket 60(1), a folded unit 65, which is folded as the tub 31 is moved in the eccentric direction, can be formed in a section (or the extension unit 63) between the casing coupling unit 61 and the tub coupling unit 62.

More specifically, the extension unit 63 is provided with a flat portion 64 extending evenly from the casing coupling unit 61 toward the tub coupling unit 62, and the folded unit 65 may be formed between the flat portion 64 and the tub coupling unit 62.

The casing coupling unit 61 may include an outer door close contact portion 68 which is bent outward from the front end of the flat portion 64 and is in close contact with the rear surface of the door 20 in the outside of the input port 12*h* in a state where the door 20 is closed. The casing coupling unit 61 may be provided with the groove 61*r* in a portion extending from the outer end of the outer door close contact portion 68.

The casing coupling unit 61 may include an inner door close contact portion 66 which is bent inward from the front end of the flat portion 64 and is in close contact with the rear surface (preferably, window 22) of the door 20 in the inside of the input port 12*h* in a state where the door 20 is closed.

The drum 40 is vibrated (i.e., the rotation center line C of the drum 40 moves) during the rotation process, and thus, the center line of the tub 31 (approximately, the same as the rotation center line C of the drum 40) is also moved. At this time, the moving direction (hereinafter, referred to as "eccentric direction") has a radial component.

The folded unit 65 is folded or unfolded when the tub 31 moves in the eccentric direction. The folded unit 65 may include a first portion 652 which is bent from the flat portion 64 toward the casing coupling unit 61, and a second portion 653 which is bent from the other end of the first portion 652 toward the tub coupling unit 62 side and connected to the tub coupling unit 62. The folded unit 65 may be formed over the entire circumference of the gasket 60(1).

Referring to FIG. 2, the drum 40 in which laundry is accommodated is rotatably provided in the tub 31. The drum 40 accommodates the laundry, has an opening through which the laundry is introduced that is disposed on the front surface, and is rotated around an approximately horizontal rotation center line C. However, "horizontal" here is not a term used mathematically as a strict sense. That is, as in the embodiment, when the rotation center line C is inclined at a certain angle (e.g., 5 degrees or less) with respect to the horizontal, it also comes close to horizontal, so that it can be said to be approximately horizontal.

A driving unit 38 for rotating the drum 40 may be further provided, and a driving shaft 38*a* that is rotated by the driving unit 38 may be coupled to the drum 40 through the rear surface portion of the tub 31.

Preferably, the drive unit 38 includes a direct connection motor, a stator of the motor is fixed to the rear side of the tub 31, and the drive shaft 38*a*, which rotates together with the rotor of the motor, rotates the drum directly.

The tub 31 can be supported by a damper 16 provided in the bottom of the casing 10. The vibration of the tub 31 caused by the rotation of the drum 40 is attenuated by the damper 16.

A water supply hose (not shown) for guiding water supplied from an external water source such as a faucet to the tub 31, and a water supply valve (not shown) for controlling the water supply hose.

The tub 31 is provided with a drain port for discharging water, and a drain bellows 17 may be connected to the drain port. A pump 36 for pumping water discharged to the drain bellows 17 may be provided.

The pump 36 can selectively perform the function of sending the water discharged through the drain bellows 17 to a drain pipe 19 and the function of sending the water to a circulation pipe 18 described later.

The pump 36 may include an impeller (not shown) for sending water, a pump housing (not shown) for accommodating the impeller, and a pump motor (not shown) for rotating the impeller. The pump housing may be provided with an inflow port (not shown) through which water is introduced through the drain bellows 17, a drain discharge port (not shown) through which the water sent by the impeller is discharged to the drain pipe 18, and a circulating water discharge port (not shown) for discharging the water sent by the impeller to the circulation pipe 18.

The pump motor may be able to accomplish forward/reverse rotation. Depending on the direction in which the impeller is rotated, water may be discharged through the drain discharge port or may be discharged through the circulating water discharge port. Such a configuration can be implemented by appropriately designing the structure of the pump housing. Since such a technology is publicized in Korean Patent Laid-Open Publication No. 10-2013-0109354, a detailed description thereof will be omitted.

The opening of the circulation pipe 18 is connected to the circulating water discharge port, and the outlet is connected to a circulating water spraying apparatus 70(1) described later. However, the present invention is not limited thereto. A circulation pump for sending the water discharged from the tub 31 to the circulation pipe 18 and a drain pump for sending the water discharged from the tub 31 to the drain pipe 19 may be separately provided. Under the control of a controller (not shown) described later, the circulation pump may be operated (e.g., during washing) or the drain pump may be operated (e.g., during draining) according to a preset algorithm.

Meanwhile, the flow rate (or discharge water pressure) of the pump 36 is variable. To this end, the pump motor configuring the pump 36 may be a variable speed motor capable of controlling the rotation speed. The pump motor may be a Brushless Direct Current Motor (BLDC) motor, but is not limited thereto. A driver for controlling the speed of the motor may be further provided, and the driver may be an inverter driver. The inverter driver converts AC power to DC power and inputs the converted DC power to the motor at a target frequency.

A controller for controlling the pump motor may be further provided. The controller may include a proportional-integral controller (PI controller), a proportional-integral-derivative controller (PID controller), and the like. The controller may receive the output value (e.g., output current) of the pump motor as an input, and control the output value of the driver so that the number of revolutions of the pump motor follows a preset target number of revolutions.

Meanwhile, it is to be understood that the controller can control not only the pump motor but also the overall operation of the washing machine, and that the control of each unit mentioned below is controlled by the controller.

Referring to FIG. 2 to FIG. 7, the circulating water spraying apparatus 70(1) may include a guide pipe 71 which is fixed to the gasket 60(1), and forms an annular flow path that guides water supplied from the pump 36, and a plurality of nozzles 73*a*, 73*b*(1), 73*b*(2), 73*c*(1), 73*c*(2) disposed in the guide pipe 71 and spray the water supplied through the guide pipe 71 into the drum 40. Hereinafter, it is illustrated that the guide pipe 71 and the plurality of nozzles 73*a*, 73*b*(1), 73*b*(2), 73*c*(1), and 73*c*(2) are integrally formed, but it is not limited thereto.

The plurality of nozzles 73*a*, 73*b*(1), 73*b*(2), 73*c*(1), and 73*c*(2) may include an upper nozzle 73*a* for spraying the circulating water downward, a pair of intermediate nozzles 73*b*(1) and 73*b*(2) which are disposed below the upper nozzle 73*a* and spray the circulating water downward while spraying deeper into the drum 40 than the upper nozzle 73*a*, and a pair of lower nozzles 73*c*(1) and 73*c*(2) which are disposed below the pair of intermediate nozzles 73*b*(1) and 73*b*(2) and spray the circulating water upwardly. In FIGS. 1, A, B and C indicate the positions of the upper nozzle 73*a*, the intermediate nozzle 73*b*(1), and the lower nozzle 73*c*(1), respectively.

The shapes of the respective nozzles 73*a*, 73*b*(1), 73*b*(2), 73*c*(1), 73*c*(2) are substantially the same, but the spraying direction differs depending on the position disposed on the guide pipe 71. Therefore, hereinafter, the configuration of the upper nozzle 73*a* described with reference to FIGS. 6 and 7 can be applied to other nozzles 73*b*(1), 73*b*(2), 73*c*(1), and 73*c*(2).

The upper nozzle 73*a* may include an opening forming surface 731 in which an opening 73*h*1 communicating with the guide pipe 71 is formed, and a collision surface 733 which extends from the lower side of the opening forming surface 731 and collides with the circulating water sprayed through the opening 73*h*1.

The upper nozzle 73*a* may include a left side surface 732(L) which extends from the left side of the opening forming surface 731 and has a lower side connected with the collision surface 733 to define a left side boundary of the water current flowing along the collision surface 733, and a right side surface 732(R) which extends from the right side of the opening forming surface 731 and has a lower side connected with the collision surface 733 to define a right side boundary of the water current flowing along the collision surface 733.

Although not shown, the upper nozzle 73*a* is a surface opposite to the collision surface 733, and may further include an upper surface which connects each upper surface of the opening forming surface 731, the left side surface 732(L), and the right side surface 732(R).

Meanwhile, the angle (α) formed by the left side surface 732(L) and the right side surface 732(R) of each of the nozzles 73*a*, 73*b*(1), 73*b*(2), 73*c*(1), 73*c*(2) is approximately 45 degrees to 55 degrees, preferably 50 degrees, but is not necessarily limited thereto.

The outlet of the upper nozzle 73*a* may be defined by the area surrounded by the collision surface 733, the left side surface 732(L), the right side surface 732(R), and the ends of the upper surface, and the outlet is opened to face the inner side of the drum 40.

A plurality of protrusions 733*a* may be arranged in the lateral direction (or in the width direction of the water current) in the end side of the collision surface 733 forming the outlet or in the vicinity of the outlet. The water current progressing along the collision surface 733 collides with the protrusion 733*a*, and is then sprayed through the outlet. As for the water current sprayed through the upper nozzle 73*a*, the water current portion that is sprayed after passing through the protrusions 733*a* is thick, whereas the water current portion that is sprayed after climbing over the protrusion 733*a* is formed to be relatively thin. Thus, a thin water film is spread out between the thick main streams.

Meanwhile, an inflow port 71*h* (see FIG. 5(*a*)), connected to the circulation pipe 18 may be formed in the lower portion of the guide pipe 71. The pair of intermediate nozzles 73*b*(1) and 73*b*(2) are formed above the inflow port 71*h* and may be disposed in the left and right sides, respectively, based on the inflow port 71*h*. The pair of intermediate nozzles 73*b*(1) and 73*b*(2) are disposed symmetrically with respect to the vertical line OV passing through the center O of the guide pipe 71 (see FIG. 5(*b*). Thus, the spraying directions of the respective intermediate nozzles 73*b*(1) and 73*b*(2) are also symmetrical with respect to the vertical line OV.

The pair of intermediate nozzles 73*b*(1) and 73*b*(2) may be positioned above the center O of the guide pipe 71 (note that OH shown in FIG. 5 is a horizontal line passing through the center O). Since the intermediate nozzles 73*b*(1) and 73*b*(2) spray the circulating water downward, when the drum 40 is viewed from the front, the circulating water passes through the area above the center C of the drum 40 at the opening side of the drum 40, and is sprayed in a downward inclined manner as it progresses deeply into the drum 40.

The pair of lower nozzles 73*c*(1) and 73*c*(2) are disposed above the inflow port 71*h* but below the pair of intermediate nozzles 73*b*(1) and 73*b*(2). The pair of lower nozzles 73*c*(1) and 73*c*(2) may be disposed in the left and right sides respectively based on the inflow port 71*h*, and preferably are disposed symmetrically with respect to the vertical line OV. Thus, the spraying directions of the respective intermediate nozzles 73*b*(1) and 73*b*(2) are symmetrical with respect to the vertical line OV. The pair of lower nozzles 73*c*(1) and 73*c*(2) may be positioned below the center O of the guide pipe 71. Since the lower nozzle 73*c*(1), 73*c*(2) sprays the circulating water upward, when the drum 40 is viewed from the front, the circulating water passes through the area below the center C of the drum 40 at the opening side of the drum 40, and is sprayed in an upward inclined manner as it progresses deeply into the drum 40.

The upper nozzle 73*a* is preferably disposed on the vertical line OV, and the shape of the circulating water sprayed through the upper nozzle 73*a* is symmetrical with respect to the vertical line OV.

The circulating water spraying apparatus 70(1) may further include a connection pipe 72 protruded outward from the inflow port 71*h* of the guide pipe 71. The circulation pipe 18 may be connected to the connection pipe 72. The connection pipe 72 is preferably formed on the vertical line OV. The connection pipe 72 may be integrally formed with the guide pipe 71.

The guide pipe 71 can be fixed to the inner circumferential surface of the gasket 60(1). The guide pipe 71 is an injection molding of synthetic resin material, and may be made of a hard material in comparison with the gasket 60(1). The outer diameter of the guide pipe 71 may be configured to have a size suitable for tight fit into the gasket 60(1). In this case, the position of the guide pipe 71 can be fixed without a separate fixing member due to the elasticity of the soft gasket 60(1). However, according to the embodiment, a projection for preventing detachment of the guide pipe 71 may be further formed on the gasket 60(1).

Since the guide pipe 71 is fixed to the inner circumferential surface of the gasket 60(1), even if the tub 31 vibrates, the circulating water spraying apparatus 70(1) is not easily detached from the gasket 60(1), and further, the guide pipe 71 is prevented from colliding with the structures outside the tub 32 (e.g., the balancers 81, 82, and 83).

Further, by the water pressure transferred along the guide pipe 71 or the water pressure sprayed from the nozzles 73*a*, 73*b*(1), 73*b*(2), 73*c*(1), and 73*c*(2), there is an effect that the guide pipe 71 is brought into close contact with the inner circumferential surface of the gasket 60(1) and is firmly fixed. A through hole (not shown) through which the connection pipe 72 passes may be formed in the gasket 60(1). The guide pipe 71 can be inserted into the annular inner circumferential surface of the gasket 60(1), after inserting the connection pipe 72 to pass through the through hole in the inside of the gasket 60(1). The circulation pipe 18 can be fitted to one end of the connection pipe 72 protruded outside the gasket 60(1) through the through hole. The circulation pipe 18 may be made of a soft hose, and may be fixed by putting a clamp on the outer circumferential surface of the hose in a state of being externally inserted to the circulation pipe 18 or by winding a wire.

The circulating water supplied through the circulation pipe 18 flows into the guide pipe 71, and then, is branched to both sides and rises along the flow path, and is sprayed sequentially from the nozzles positioned below. The operating pressure of the pump 36 may be controlled to such an extent that the circulating water can reach the upper nozzle 73*a*.

Meanwhile, the spraying pressure of the nozzles 73*a*, 73*b*(1), 73*b*(2), 73*c*(1), 73*c*(2) can be varied by controlling the speed of the pump motor. As one embodiment of such spraying pressure control, the speed of the pump motor may be controlled within a range where spraying is performed by all the nozzles 73*a*, 73*b*(1), 73*b*(2), 73*c*(1), 73*c*(2). While the circulating water is sprayed by the nozzles 73*a*, 73*b*(1), 73*b*(2), 73*c*(1), 73*c*(2), a filtration motion in which the laundry is rotated together with the drum 40 in a state of being adhered to the inner surface of the drum 40 may be performed. The filtration motion may be performed a plurality of times. The acceleration of the pump motor may be synchronized with the execution timing of each of the filtration motions and the deceleration may be synchronized with the timing of braking the drum 40 for the termination of each filtration motion.

That is, when the drum 40 starts to accelerate for the filtration motion, the pump motor is also accelerated so that the spraying pressure through the nozzle 73*a*, 73*b*(1), 73*b* (2), 73*c* (1), 73*c*(2) can be maximized when the laundry is completely adhered to the drum 40 and rotated together with the drum 40 (i.e., in the state where the centrifugal force is larger than the gravity so that the laundry does not fall even when the laundry reaches the peak due to the rotation). The circulating water sprayed from the nozzles 73*a*, 73*b*(1), 73*b*(2), 73*c*(1), 73*c*(2) reaches the deepest portion of the drum 40 when the rotation speed of the pump motor becomes a maximum during the filtration motion. Particularly, the circulating water sprayed through the intermediate nozzle 73*b*(1), 73*b*(2) can reach the deepest portion of the drum 40 in comparison with other nozzles 73*a*, 73*c*(1), and 73*c*(2).

Referring to FIG. 5, with respect to the center O of the guide pipe 71, the intermediate nozzle 73*b*(1), 73*b*(2) may form an angle θ1 with the upper nozzle 73*a*, and the lower nozzle 73*c*(1), 73*c*(2) may form an angle θ2 with the intermediate nozzles 73*b*(1), 73*b*(2). θ1 may be approximately 50 degrees to 60 degrees, preferably 55 degrees, but it is not necessarily limited thereto. Further, θ2 may be approximately 55 degrees to 65 degrees, preferably 60 degrees, but it is not necessarily limited thereto. FIG. 7 shows the spraying angles (the angle formed by the opening forming surface 731 of each of the nozzles 73*a*, 73*b*(1), 73*b*(2), 73*c*(1), 73*c*(2) with the collision surface 733) of the respective nozzles 73*a*, 73*b*(1), 73*b*(2), 73*c*(1), and 73*c*(2). Referring to FIG. 7, the spraying angle of each of the nozzles 73*a*, 73*b*(1), 73(2), 73*c*(1), 73*c*(2) is determined depending on where the nozzles 73*a*, 73*b*(1), 73(2), 73*c*(1), 73*c*(2) are positioned on the guide pipe 71. Preferably, the spraying angle β1 of the upper nozzle 73*a* is the largest, the spraying angle β2 of the intermediate nozzle 73*b*(1), 73*b*(2) is next to the spraying angle β1 of the upper nozzle 73*a*, and the spraying angle β3 of the lower nozzle 73*c*(1), 73*c*(2) is the smallest. When θ1 is 55 degrees and θ2 is 60 degrees, the spraying angle β1 of the upper nozzle 73*a* is approximately 46 degrees, the spraying angle β2 of the intermediate nozzle 73*b*(1), 73*b*(2) is approximately 32 degrees, and the spraying angle β3 of the lower nozzle 73*c*(1), 73*c*(2) is approximately 27 degrees.

The guide pipe 71 may be disposed on the inner circumferential surface of the flat portion 64. In the gasket 60(1), the portion deformed in response to the vibration of the tub 31 is mainly the folded unit 65, and the flat portion 64 is only translationally moved in accordance with the deformation of the folded unit 65 while maintaining its shape substantially in the original shape. Therefore, the gasket 60(1) may be disposed in the flat portion 64 which is a portion that is less deformed and is not affected even if it is not deformed, thereby minimizing the influence on the function of the gasket 60(1) and obtaining an advantage from the viewpoint of maintaining the rigidity of the stator 71.

Meanwhile, the gasket 60(1) may be further provided with a direct water nozzle 42 and a steam nozzle 44. The direct water nozzle 42 sprays water (i.e., direct water) supplied from an external water source (e.g., a faucet) into the drum 40. The flat portion 64 of the gasket 60(1) may be provided with a first installation pipe 67 on which the direct water nozzle 42 is installed. The first installation pipe 67 is protruded from the circumference of a first through-hole formed in the flat portion 64 to the outside of the gasket 60(1), and a direct water inflow pipe 42*a* of the direct water nozzle 42 is protruded outward while passing through the first installation pipe 67 in the inside of the gasket 60(1). A direct water supply pipe (not shown) for supplying direct water may be connected to the direct water inflow pipe 42*a*.

The washing machine according to an embodiment of the present invention may include a steam generator (not shown) for generating steam. The steam nozzle 44 sprays steam generated by the steam generator into the drum 40. The flat portion 64 of the gasket 60(1) may be provided with a second installation pipe 69 on which the steam nozzle 44 (see FIG. 4) is installed. The second installation pipe 69 is protruded from the circumference of a second through hole formed in the flat portion 64 to the outside of the gasket 60(1), and a steam inflow pipe 44*a* of the steam nozzle 44 is protruded outward while passing through the second installation pipe 69 in the inside of the gasket 60(1). A steam flow pipe (not shown) for guiding steam generated from the steam generator may be connected to the steam inflow pipe 44*a*.

On the flat portion 64, the upper nozzle 73*a* is positioned in the front side of the direct water nozzle 42. Depending on embodiments, as shown in FIG. 7(*a*), both can be disposed on substantially the same line when viewed from the side. In this case, the circulating water sprayed from the upper nozzle 73*a* should not interfere with the direct water nozzle 42. From this point of view, it is preferable that the outlet (or spraying port) of the upper nozzle 73*a* is positioned below the direct water nozzle 42 or at least does not meet with the direct water nozzle 42 even if the tangent line of the collision surface 733*a* is extended.

On the other hand, contrary to the embodiment, it is also possible that the steam nozzle 44 is installed in the first installation pipe 67 and the direct water nozzle 42 is installed in the second installation pipe 69. In this case as well, similarly to the above description, it is preferable that the outlet of the upper nozzle 73*a* is positioned below the steam nozzle 44, or at least does not meet with the steam nozzle 44 even if the tangent line of the collision surface 733*a* is extended.

Meanwhile, the reference numerals 733*a*, 733*b*, and 733*c* indicated in FIG. 7 denote the collision surface 733 of the upper nozzle 73*a*, the intermediate nozzle 73*b*(1), and the lower nozzle 73*c*(1) respectively, the reference numerals 732*a*(L), 732*b*(L), and 732*c*(L) denote the left side surface 732 of the upper nozzle 73*a*, the intermediate nozzle 73*b*(1), and the lower nozzle 73*c*(1) respectively, and the reference numerals 73*ah*, 73*bh*, and 73*ch* denote the opening of the upper nozzle 73*a*, the intermediate nozzle 73*b*(1), and the lower nozzle 73*c*(1) respectively.

Figure 8:
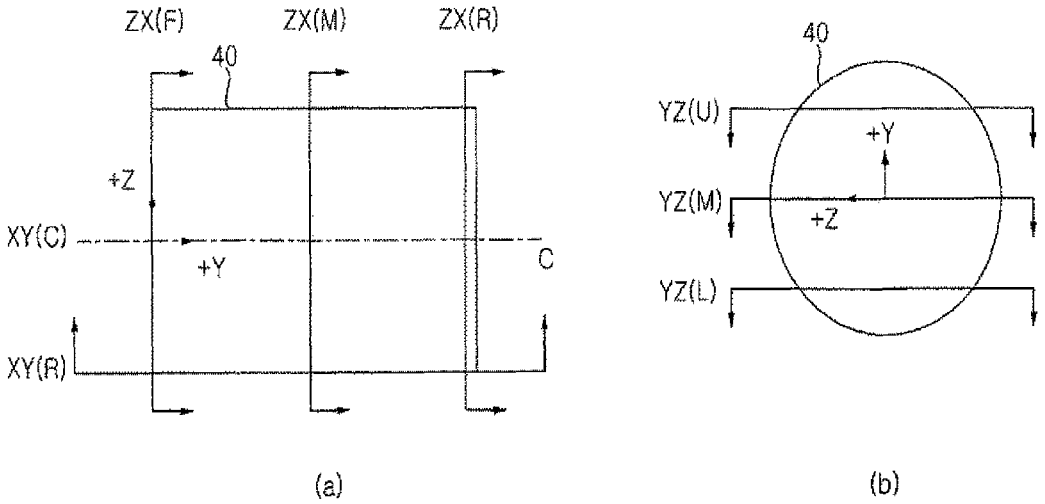
FIG. 8 schematically shows a drum (a) viewed from above, and a drum (b) viewed from the front.

FIG. 8 schematically shows a drum (a) viewed from above and a drum (b) viewed from the front. Referring to FIG. 8, terms to be used in below will be defined.

In FIG. 8, the rear direction, the upward direction, and the left direction are represented by +Y, +X, and +Z respectively, based on the front view of the drum 40. ZX(F) represents a ZX plane approximately on the front surface of the drum 40, ZX(M) represents the ZX plane approximately at the intermediate depth of the drum 40, and ZX(R) represents the ZX plane approximately in the vicinity of the rear surface portion 420 of the drum 40.

Further, XY(R) shows the XY plane positioned in the right end of the drum 40, and XY(C) represents the XY plane (or vertical plane) to which the center C of the drum 40 belongs.

Further, YZ(M) represents a YZ plane of approximately the middle height of the drum 40, YZ(U) represents the YZ plane positioned above YZ(M), and YZ(L) represents the YZ plane positioned below YZ(M).

Figure 9:
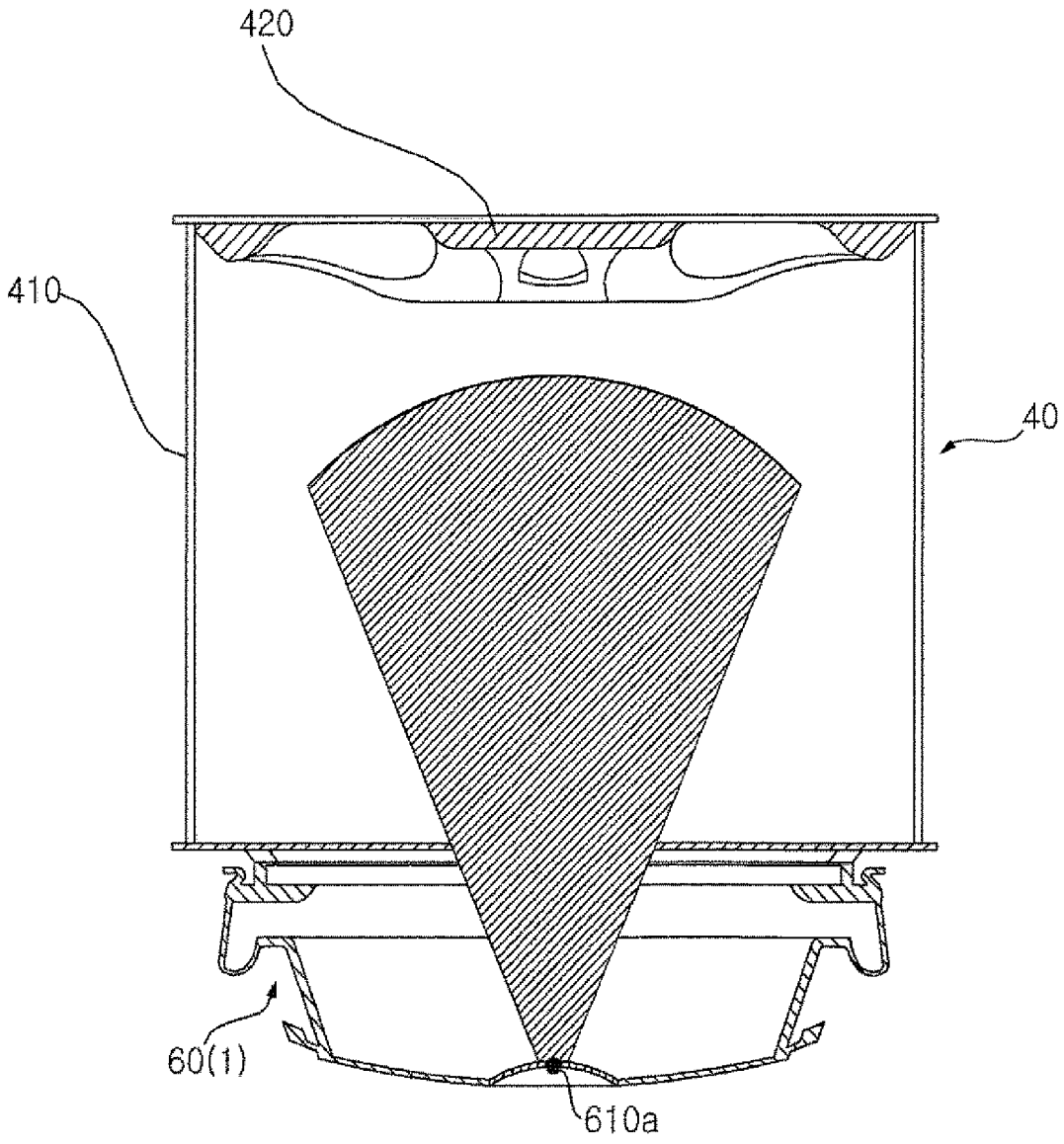
FIG. 9 shows a spray pattern of an upper nozzle taken along YZ(U) shown in FIG. 8.
Figure 10:
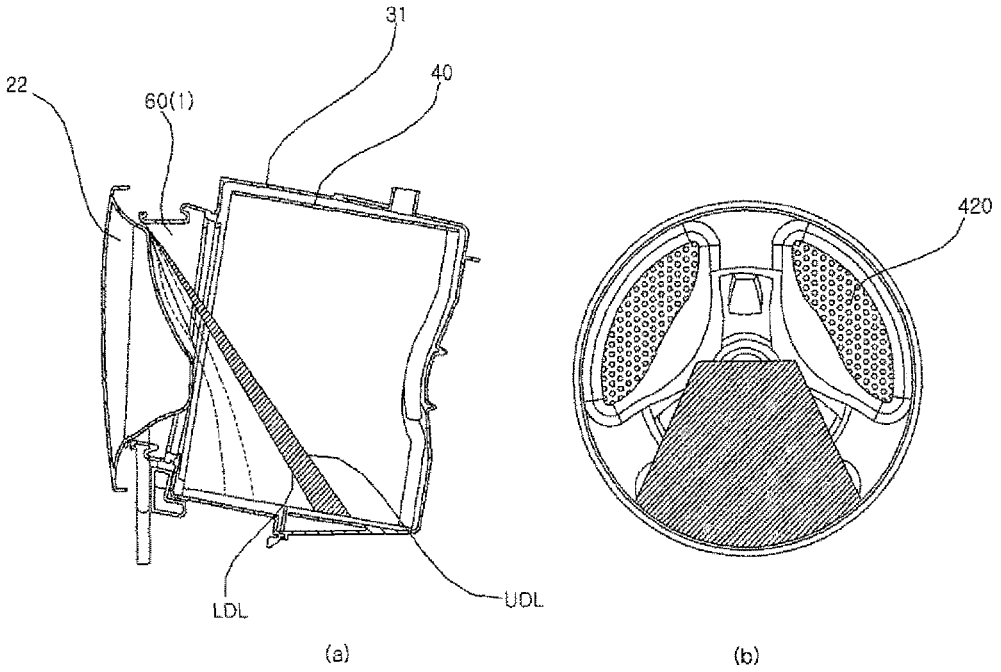
FIG. 10(*a*) shows a spray pattern of an upper nozzle taken along XY(R) shown in FIG. 8, and FIG. 10(*b*) is a view taken along ZX(M) shown in FIG. 8.

FIG. 9 shows a spray pattern of an upper nozzle taken along YZ(U) shown in FIG. 8. FIG. 10(*a*) shows a spray pattern of an upper nozzle taken along XY(R) shown in FIG. 8, and FIG. 10(*b*) is a view taken along ZX(M) shown in FIG. 8.

Referring to FIGS. 9 and 10, as shown in FIG. 10 (*a*), the water current sprayed through the upper nozzle 73*a* is sprayed in the form of a water film having a certain thickness, and the thickness of the water film may be defined between the upper boundary (UDL) and the lower boundary (LDL). Hereinafter, the water current shown in the drawings indicates the surface forming the upper boundary (UDL), and the surface forming the lower boundary (LDL) is omitted.

The water current indicated by a dotted line in FIG. 10(*a*) represents a case where water pressure is lowered (i.e., a case where the rotation speed of the pump motor is decreased) in comparison with a case of being indicated by a solid line (a case of maximum water pressure). As the water pressure drops, the intensity of the water current also weakens, so that the area which the water current can reach is shifted to the opening side of the drum 40.

In particular, the window 22 is protruded toward the drum 40 more than the upper nozzle 73*a*. Thus, when the number of revolutions of the pump motor is lower than a certain level, the water current sprayed through the upper nozzle 73*a* can reach the window 22, and in this case, there is an effect that the window 22 is cleaned.

The water current sprayed through the upper nozzle 73*a* is symmetrical with respect to XY(C), and does not reach the rear surface portion 420 of the drum 40. As described above, the spraying direction of the upper nozzle 73*a* is determined according to the configuration of the collision surface 733 (e.g., the angle formed by the collision surface 733 with the opening forming surface 731). Therefore, even if the water pressure is continuously increased, the sprayed area cannot escape a certain area. The water currents shown by solid lines in FIGS. 9 to 14 show the state in which the water current is sprayed at the maximum intensity through the respective nozzles.

Referring to FIGS. 9 and 10 again, the upper nozzle 73*a* may be configured to spray the circulating water toward the side surface portion 410 of the drum 40. Specifically, the upper nozzle 73*a* sprays the circulating water downward toward the inside of the drum 40. At this time, the sprayed circulating water reaches the side surface portion 410 but does not reach the rear surface portion 420. Preferably, the water current sprayed through the upper nozzle 73*a* reaches the side surface portion 410 of the drum 40 in an area exceeding half the depth of the drum 40 (see FIG. 10(*b*)).

Figure 11:
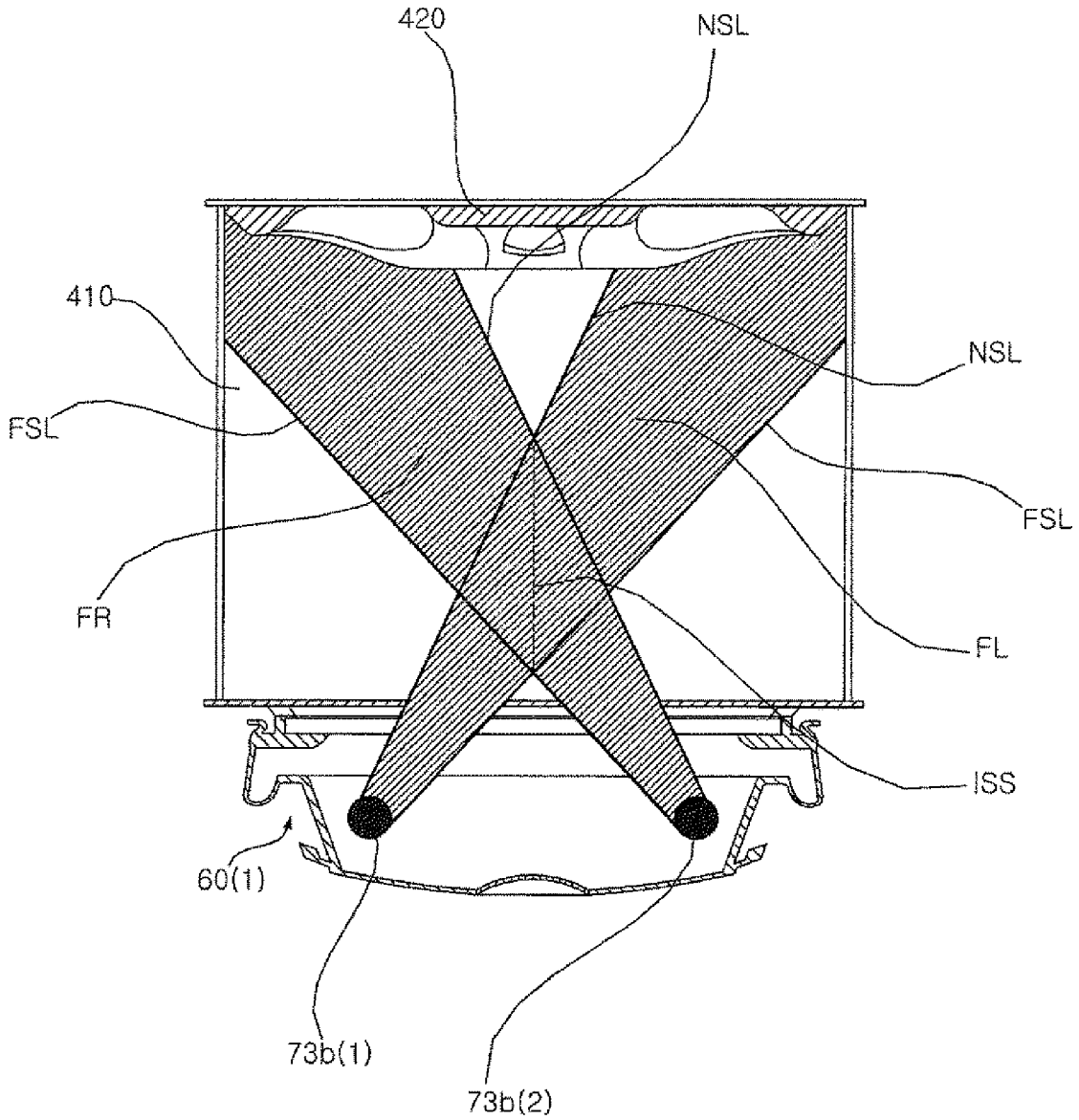
FIG. 11 shows a spray pattern of intermediate nozzles taken along YZ(U) shown in FIG. 8.
Figure 12:
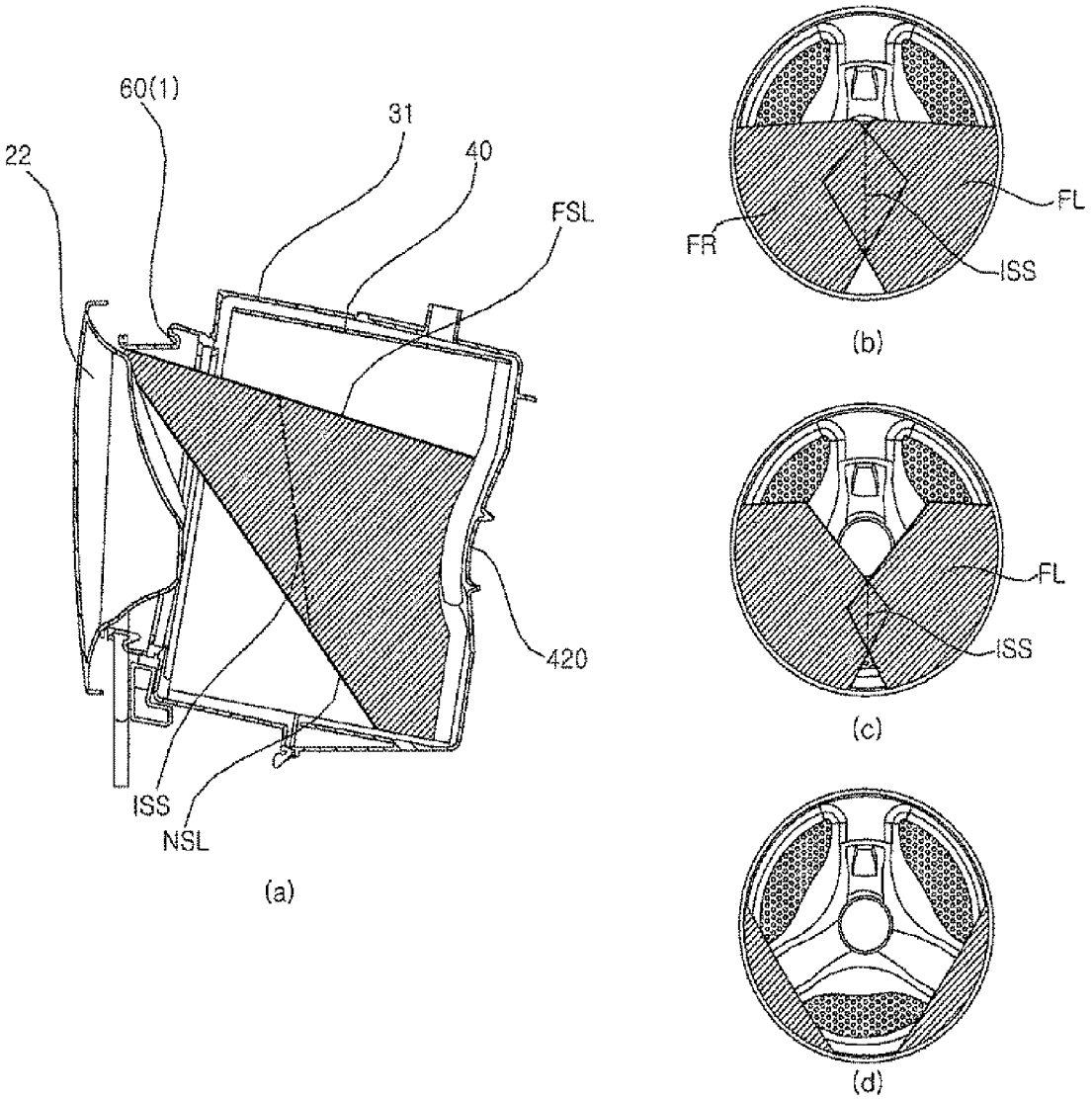
FIG. 12 shows a spray pattern (a) of a first intermediate nozzle taken along XY(R) shown in FIG. 8, a spray pattern (b) of intermediate nozzles 73*b*(1) and 73*b*(2) taken along ZX(F) shown in FIG. 8, a spray pattern (c) taken along ZX(M), and a spray pattern (d) taken along ZX(R).

FIG. 11 shows a spray pattern of intermediate nozzles taken along YZ(U) shown in FIG. 8. FIG. 12 shows a spray pattern (a) of a first intermediate nozzle taken along XY(R) shown in FIG. 8, a spray pattern (b) of intermediate nozzles 73*b*(1) and 73*b*(2) taken along ZX(F) shown in FIG. 8, a spray pattern (c) taken along ZX(M), and a spray pattern (d) taken along ZX(R).

Referring to FIGS. 11 and 12, the pair of intermediate nozzles 73*b*(1) and 73*b*(2) may include a first intermediate nozzle 73*b*(1) which is disposed in one side (or a first area) of the left and right sides based on the XY(C) plane and sprays the circulating water toward the other side (or a second area), and a second intermediate nozzle 73*b*(2) which is disposed in the other side based on the XY(C) plane and sprays the circulating water toward the one side.

The first intermediate nozzle 73*b*(1) and the second intermediate nozzle 73*b*(2) are disposed symmetrically with respect to the XY(C) plane, and the spraying directions of respective the intermediate nozzles 73*b*(1), 73*b*(2) are also symmetrical. The water current sprayed through each of the intermediate nozzles 73*b*(1) and 73*b*(2) has a width defined between one side boundary NSL adjacent to the side in which the nozzle is disposed and the other side boundary FSL opposite to the one side boundary NSL.

The one side boundary NSL may be positioned below the other side FSL. Preferably, one side boundary NSL meets the side surface portion 410 of the drum 40, and the other side boundary FSL meets the side surface portion 410 of the drum 40 at a position higher than the one side boundary NSL. That is, the water current sprayed by the intermediate nozzle 73(1), 73*b*(2) forms a tilted water film which is downwardly directed from the other side to one side.

The water current sprayed through each of the intermediate nozzles 73(1) and 73*b*(2) reaches an area formed between a point where the one side boundary NSL meets the side surface portion 410 of the drum 40 and a point where the other side boundary FSL meets the side surface portion 410 of the drum, and the area includes an area that meets the rear surface portion 420 of the drum 40. That is, a section where the water current meets the drum 40 passes through the rear surface portion 420 of the drum 40 while progressing downward toward the point where the one side boundary NSL meets the side surface portion 410 of the drum 40 from the point where the other side boundary FSL meets the side surface portion 410 of the drum.

Hereinafter, it is illustrated that the first intermediate nozzle 73*b*(1) is disposed in the left side (hereinafter, referred to as "left side area") based on the XY(C) plane, and the second intermediate nozzle 73*b*(2) is disposed in the right side (hereinafter, referred to as "right side area") based on the XY(C) plane. The spraying shape of the intermediate nozzles 73*b*(1) and 73*b*(2) will be described in more detail.

The first intermediate nozzle 73*b*(1) sprays the circulating water toward the right side area. That is, the water current sprayed through the first intermediate nozzle 73*b*(1) is not symmetrical with respect to the XY(C) plane but is deflected to the right side.

The left side boundary NSL (one side boundary NSL) of the water current FL sprayed through the first intermediate nozzle 73*b*(1) is positioned below the right side boundary FSL (or the other side boundary FSL), and meets the side surface portion 410 of the drum 40. The right side boundary FSL (or the other side boundary FSL) of the water current FL sprayed through the first intermediate nozzle 73*b*(1) also meets the side surface portion 410 of the drum 40.

The right side boundary FSL of the water current FL sprayed through the first intermediate nozzle 73*b*(1) meets the side surface portion 410 of the drum 40, preferably, at a position higher than the center C of the drum 40.

The section where the water current FL sprayed through the first intermediate nozzle 73*b*(1) meets the drum 40 meets the rear surface portion 420 of the drum 40 while progressing downward in the left direction from a point where the right side boundary FSL meets the side surface portion 410 of the drum 40, and then reaches a point where the left side boundary NSL meets the side surface portion 410 of the drum 40 while meeting the side surface portion 410 of the drum 40 again.

The second intermediate nozzle 73*b*(2) sprays the circulating water toward the left side area. That is, the water current sprayed through the second intermediate nozzle 73*b*(2) is not symmetrical with respect to the XY(C) plane but is deflected to the right side.

The right side boundary NSL (or one side boundary NSL) of the water current FR sprayed through the second intermediate nozzle 73*b*(2) is positioned below the left side boundary FSL (or the other side boundary FSL), and meets the side surface portion 410 of the drum 40. The left side boundary FSL (or the other side boundary FSL) of the water current FR sprayed through the second intermediate nozzle 73*b*(2) also meets the side surface portion 410 of the drum 40.

The left side boundary FSL of the water current FR sprayed through the second intermediate nozzle 73*b* meets the side surface portion 410 of the drum 40, preferably, at a position higher than the center C of the drum 40.

The section where the water current FR sprayed through the second intermediate nozzle 73*b*(2) meets the drum 40 meets the rear surface portion 420 of the drum 40 while progressing downward in the right direction from a point where the left side boundary FSL meets the side surface portion 410 of the drum 40, and then reaches a point where the right side boundary NSL meets the side surface portion 410 of the drum 40 while meeting the side surface portion 410 of the drum 40 again.

In the drawing, a portion (hereinafter, referred to as "intersection section") where the water current FL sprayed from the first intermediate nozzle 73*b*(1) intersects with the water current FR sprayed from the second intermediate nozzle 73*b*(2) is indicated as ISS. The intersection section ISS starts from the front side of the intermediate depth of the drum 40 and progresses rearward and is terminated before reaching the rear surface portion 420 of the drum 40. The intersection section ISS forms a line segment downward from the front end to the rear end when viewed from the side (See FIG. 12(*a*)). The intersection section ISS preferably is terminated at a depth deeper than the intermediate depth of the drum 40 (See FIG. 12(*c*)).

Figure 13:
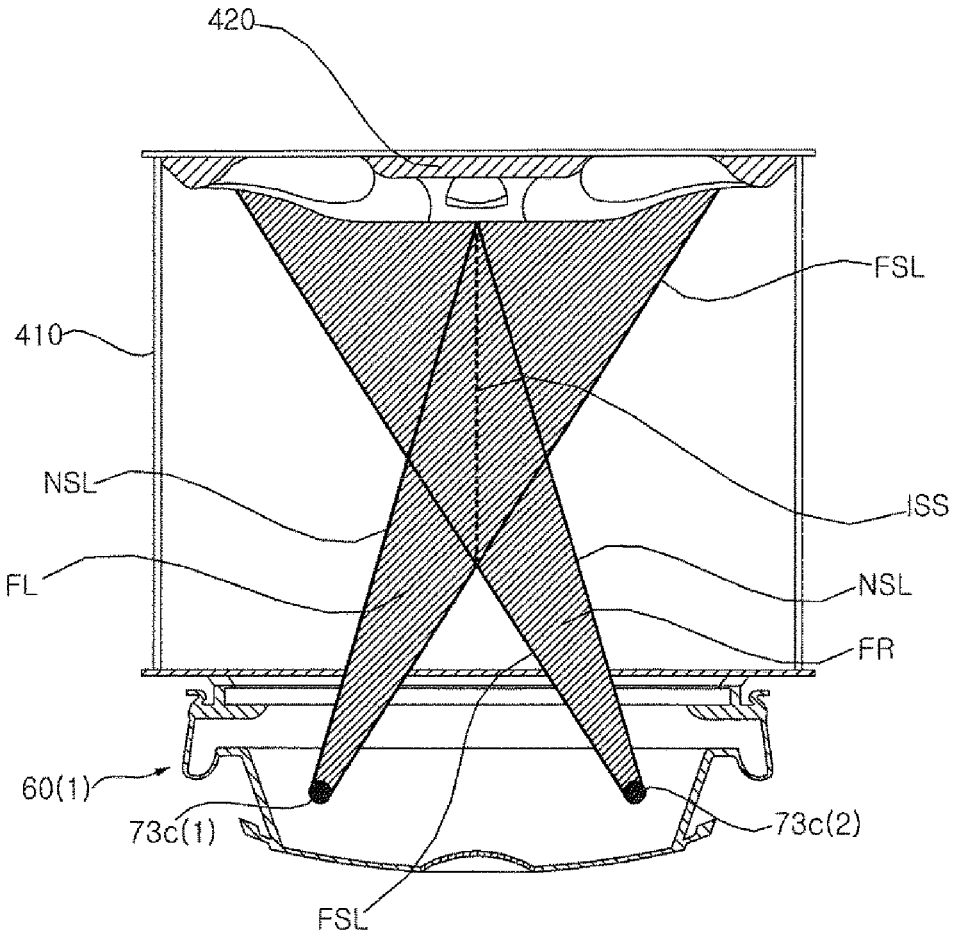
FIG. 13 shows a spray pattern of lower nozzles taken along YZ(U) shown in FIG. 8.
Figure 14:
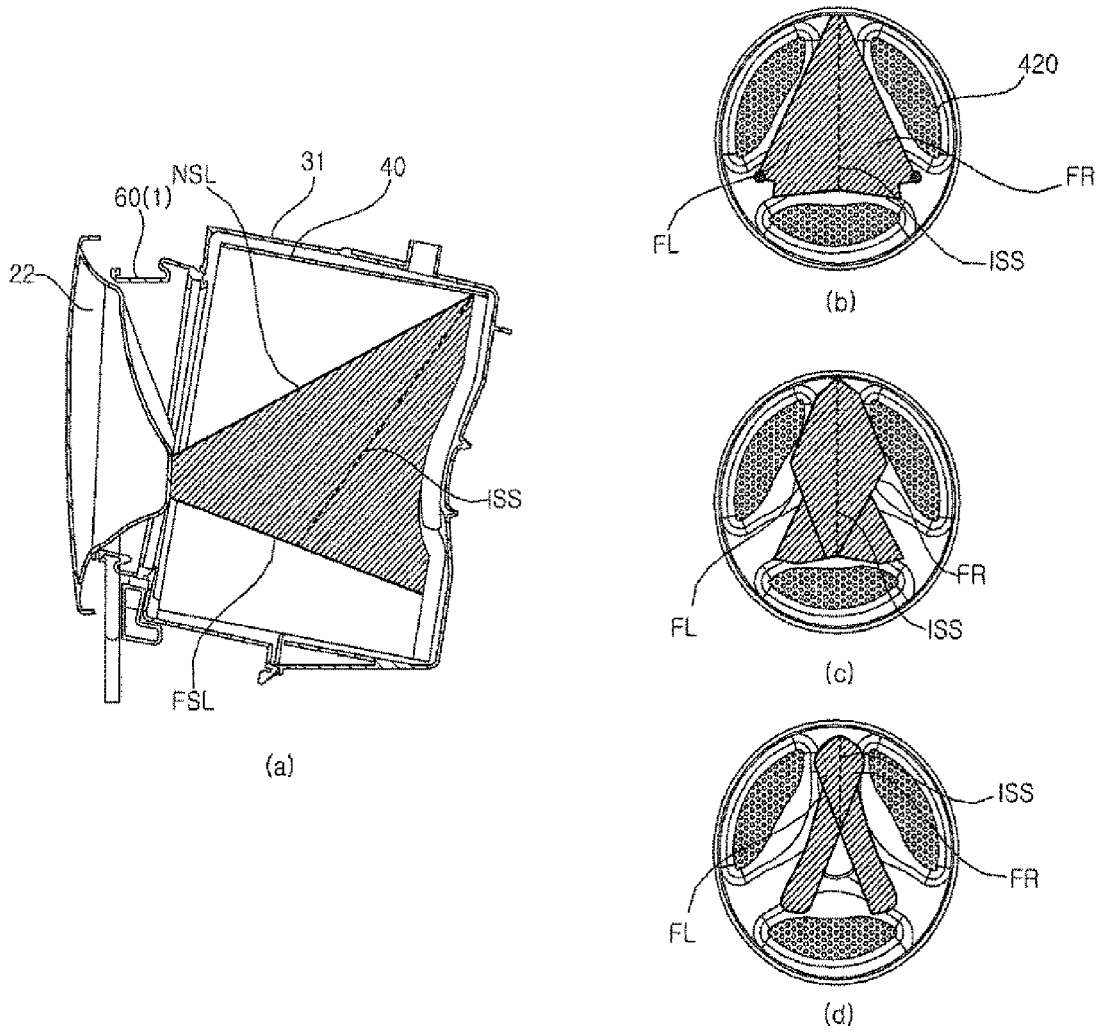
FIG. 14 shows a spray pattern (a) of a first lower nozzle taken along XY(R) shown in FIG. 8, a spray pattern (b) of lower nozzles taken along ZX(F) shown in FIG. 8, a spray pattern (c) taken along ZX(M), and a spray pattern (d) taken along ZX(R).

FIG. 13 shows a spray pattern of lower nozzles taken along YZ(U) shown in FIG. 8. FIG. 14 shows a spray pattern (a) of a first lower nozzle taken along XY(R) shown in FIG. 8, a spray pattern (b) of lower nozzles taken along ZX(F) shown in FIG. 8, a spray pattern (c) taken along ZX(M), and a spray pattern (d) taken along ZX(R).

Referring to FIGS. 13 and 14, a pair of lower nozzles 73*c*(1) and 73*c*(2) may include a first lower nozzle 73*c*(1) which is disposed in one side (or a first area) of the left and right sides based on the XY(C) plane and sprays the circulating water toward the other side (or a second area), and a second lower nozzle 73*c*(2) which is disposed in the other side based on the XY(C) plane and sprays the circulating water toward the one side.

The first lower nozzle 73*c*(1) and the second lower nozzle 73*c*(2) are disposed symmetrically with respect to the XY(C) plane, and the spraying directions of the respective lower nozzles 73*c*(1) and 73*c*(2) are also symmetrical. The water current sprayed through each of the lower nozzles 73*c*(1) and 73*c*(2) has a width defined between one side boundary NSL adjacent to the side in which the nozzle is disposed and the other side boundary FSL opposite to the one side boundary.

The one side boundary NSL may be positioned above the other side FSL. Preferably, one side boundary NSL meets the rear surface portion 420 of the drum 40, and the other side boundary FSL meets the rear surface portion 420 of the drum 40 at a position lower than the one side boundary NSL. That is, the water current sprayed by the lower nozzle 73*c*(1) and 73*c*(2) forms a tilted water film which is downwardly directed from one side to the other side.

The water current sprayed through each of the lower nozzles 73*c*(1) and 73*c*(2) reaches an area formed between a point where the one side boundary NSL meets the rear surface portion 420 of the drum 40 and a point where the other side boundary FSL meets the rear surface portion 420 of the drum.

Hereinafter, it is illustrated that the first lower nozzle 73*c*(1) is disposed in the left side (hereinafter, referred to as "left side area") based on the XY(C) plane, and the second lower nozzle 73*c*(2) is disposed in the right side (hereinafter, referred to as "right side area") based on the XY(C) plane. The spraying shape of the intermediate nozzles 73*b*(1) and 73*b*(2) will be described in more detail.

The first lower nozzle 73*c*(1) sprays the circulating water toward the right side area. That is, the water current sprayed through the first lower nozzle 73*c*(1) is not symmetrical with respect to the XY(C) plane but is deflected to the right side.

The left side boundary NSL (one side boundary NSL) of the water current FL sprayed through the first lower nozzle 73*c*(1) is positioned above the right side boundary FSL (or the other side boundary FSL), and meets the rear surface portion 420 of the drum 40. The right side boundary FSL (or the other side boundary FSL) of the water current FL sprayed through the first lower nozzle 73*c*(1) also meets the rear surface portion 420 of the drum 40.

The left side boundary NSL of the water current FL sprayed through the first lower nozzle 73*c*(1) meets the rear surface portion 420 of the drum 40, preferably, at a position higher than the center C of the drum 40. The right side boundary FSL of the water current FL sprayed through the first lower nozzle 73*c*(1) meets the rear surface portion 420 of the drum 40, preferably, at a position lower than the center C of the drum 40.

The section where the water current FL sprayed through the first lower nozzle 73*c*(1) meets the drum 40 reaches a point where the right side boundary FSL meets the rear surface portion 420 of the drum 40 while progressing downward in the right direction from a point where the left side boundary NSL meets the rear surface portion 420 of the drum 40.

The second lower nozzle 73*c*(2) sprays the circulating water toward the right side area. That is, the water current sprayed through the second lower nozzle 73*c*(2) is not symmetrical with respect to the XY(C) plane but is deflected to the right side.

The right side boundary NSL (or one side boundary NSL) of the water current FR sprayed through the second lower nozzle 73*c*(2) is positioned above the left side boundary FSL (or the other side boundary FSL), and meets the rear surface portion 420 of the drum 40. The left side boundary FSL (or the other side boundary FSL) of the water current FR sprayed through the second lower nozzle 73*c*(2) also meets the rear surface portion 420 of the drum 40.

The right side boundary NSL of the water current FR sprayed through the second lower nozzle 73*c*(2) meets the rear surface portion 420 of the drum 40, preferably, at a position higher than the center C of the drum 40. The left side boundary NSL of the water current FL sprayed through the first lower nozzle 73*c*(1) meets the rear surface portion 420 of the drum 40, preferably, at a position lower than the center C of the drum 40.

The section where the water current FR sprayed through the second lower nozzle 73*c*(2) reaches a point where the left side boundary FSL meets the rear surface portion 420 of the drum 40 while progressing downward in the left direction from a point where the right side boundary NSL meets the rear surface portion 420 of the drum 40.

In the drawing, a portion (hereinafter, referred to as "intersection section") where the water current FL sprayed from the first lower nozzle 73*c*(1) intersects with the water current FR sprayed from the second lower nozzle 73*c*(2) is indicated as ISS. The intersection section ISS forms a line segment upward from the front end to the rear end when viewed from the side (See FIG. 14(*a*)). The intersection section ISS preferably is terminated at a depth (preferably, a position closer to the rear surface portion 420 than the intermediate depth of the drum 40) deeper than the intermediate depth of the drum 40 (See FIG. 14(*d*)).

Figure 15:
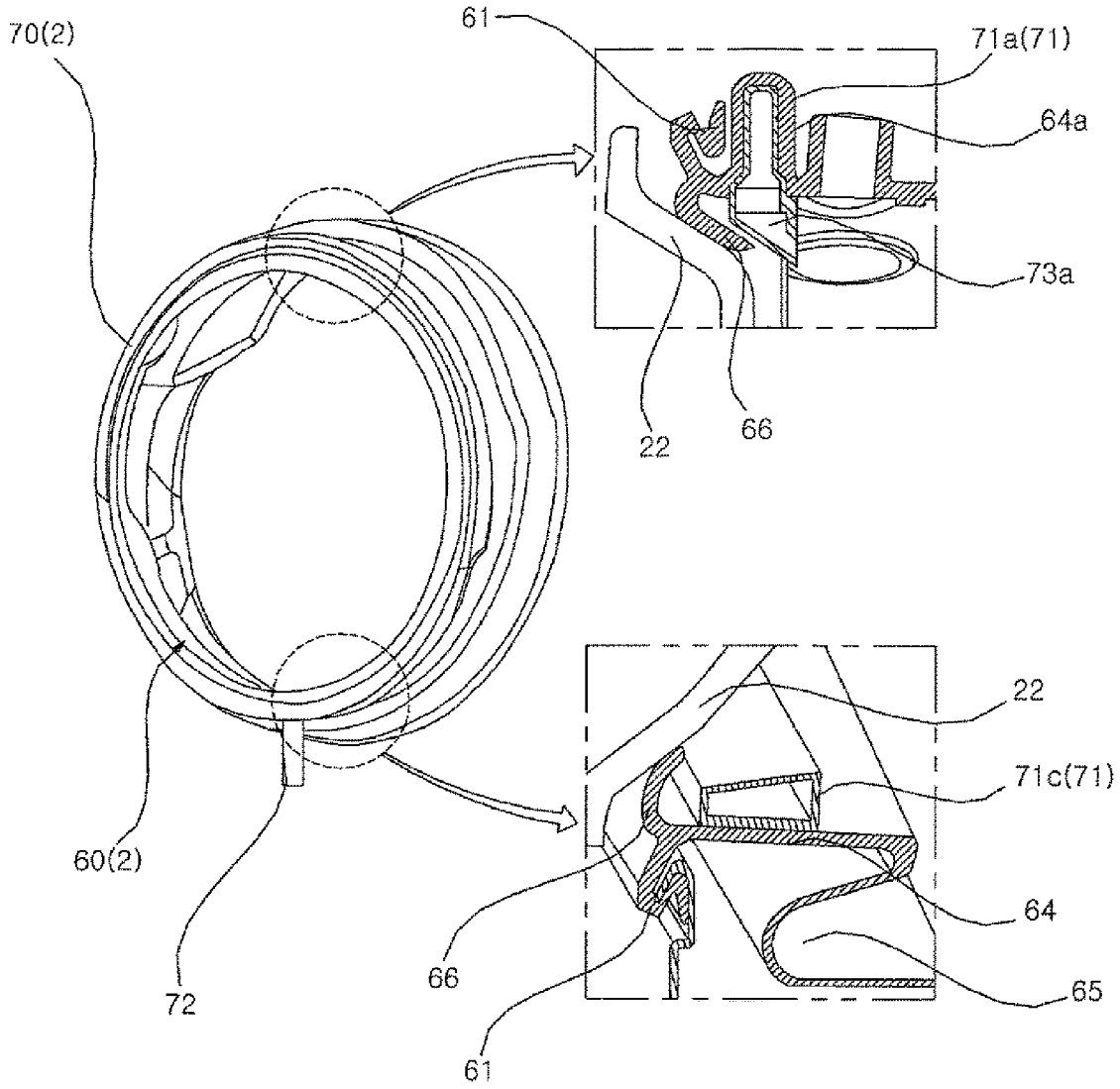
FIG. 15 shows an assembly of a gasket and a circulating water spraying apparatus according to a second embodiment of the present invention.
Figure 16:
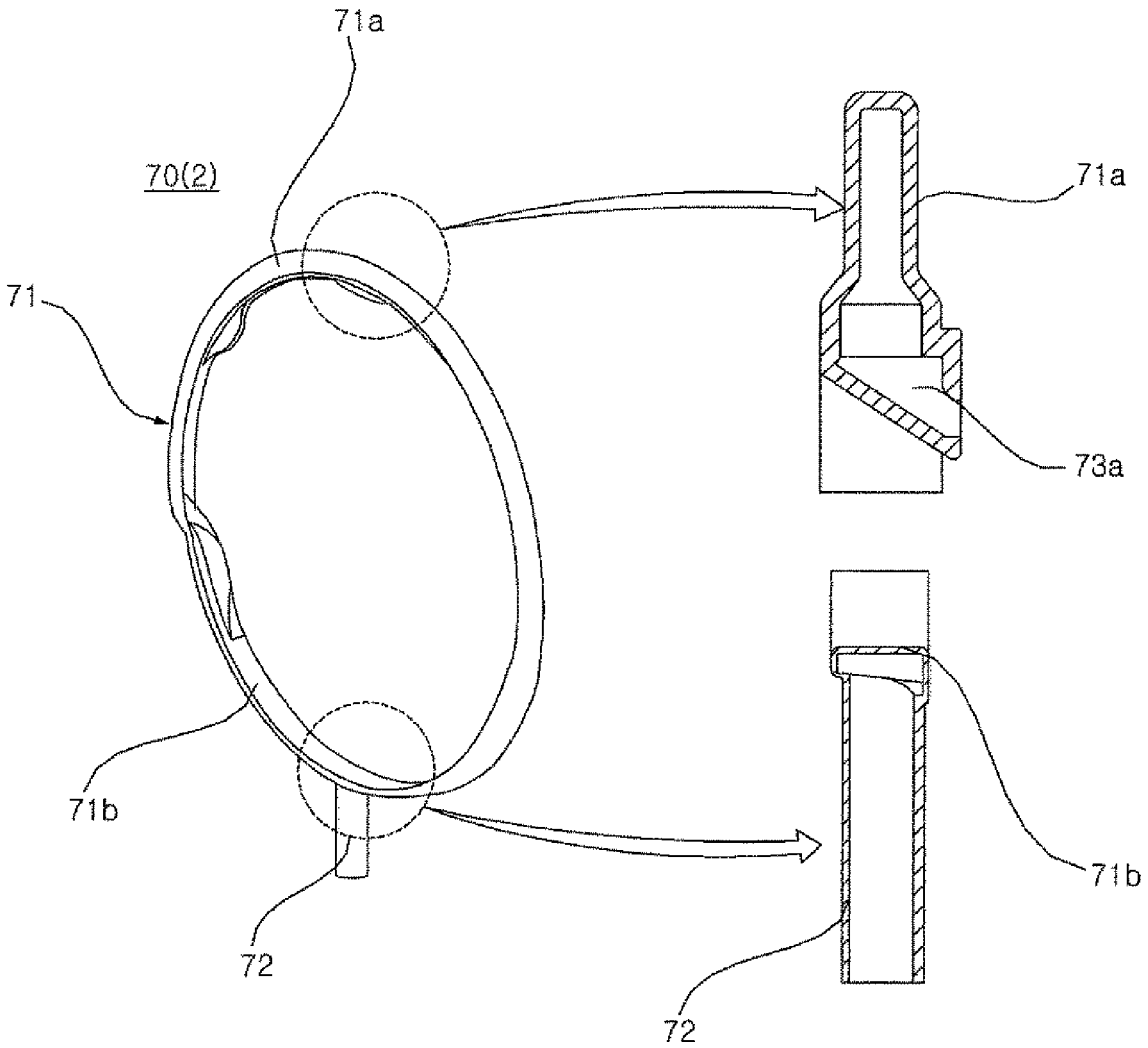
FIG. 16 is a perspective view of the circulating water spraying apparatus shown in FIG. 15, and enlarged views of an upper nozzle and a cross-sectional view of connection pipe.

FIG. 15 shows an assembly of a gasket and a circulating water spraying apparatus according to a second embodiment of the present invention. FIG. 16 is a perspective view of the circulating water spraying apparatus shown in FIG. 15, and enlarged views of an upper nozzle and a cross-sectional view of connection pipe. Hereinafter, the same reference numerals are assigned to the same components as those of the above-described embodiment, and the description thereof will be made as described above.

According to a second embodiment of the present invention, the gasket 60(2) may be provided with an accommodating groove 64*a* for accommodating the guide pipe 71. It is preferable that the accommodating groove 64*a* is formed in the flat portion 64. A part of the flat portion 64 is protruded to the outside of the gasket 60(2), and the accommodating groove 64*a* may be formed on the inner circumferential surface of the flat portion 64. The accommodating groove 64*a* may be formed to have an annular shape, but preferably it is sufficient that, as in the embodiment, the accommodating groove 64*a* may be formed in an upper area (or a certain upper area defined by including the highest point of the guide pipe 71) excluding a certain lower area defined by including a point (preferably, the lowermost point of the guide pipe 71) where the connection pipe 72 is connected. Since the lower area of the guide pipe 71 is not easily shaken by the influence of the connection pipe 72 fixed to the gasket 60(2), even if it is accommodated in the accommodating groove 64*a* only in the upper area of the guide pipe 71, the guide pipe 71 can be firmly fixed sufficiently.

Meanwhile, referring to FIG. 15 and FIG. 16, the guide pipe 71 has an upper area 71*a* corresponding to a portion to be inserted into the accommodating groove 64*a* and a lower area 71*c* which is in close contact with the inner circumferential surface of the gasket 60(2) in an area where the accommodating groove 64*a* is not formed, and the cross-sectional shapes of the upper area 71*a* and the lower area 71*c* may be configured to be different from each other. The upper area 71*a* has a shape corresponding to the accommodating groove 64*a*. That is, the cross-sectional shape of the upper area 71*a* is elongated outward along the radial direction from the center O of the gasket 60(2). The cross-sectional shape of the lower area 71*c* is elongated in the forward and backward direction (or the width direction of the flat portion 64) rather than the radial direction so as to widen the contact area with the flat portion 64.

Figure 17:
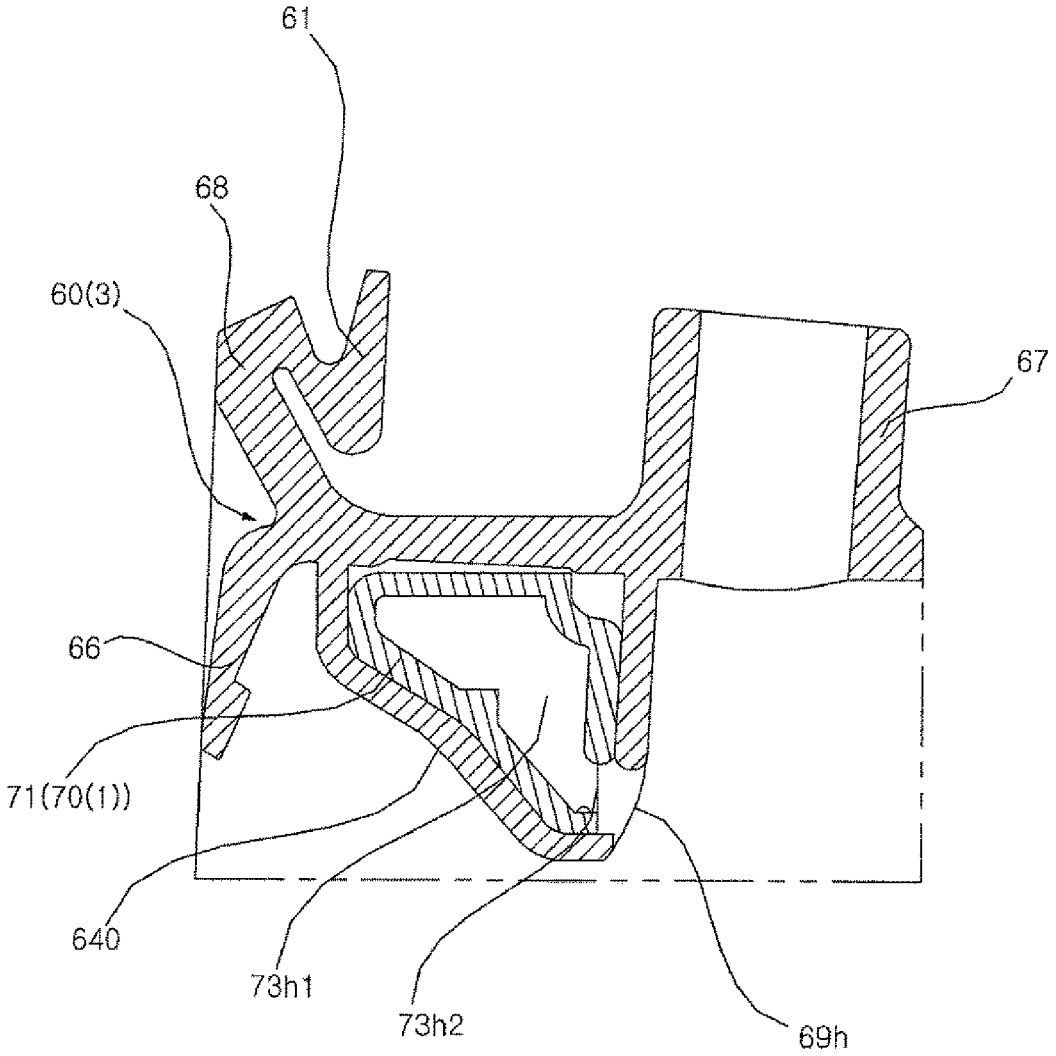
FIG. 17 is a cross sectional view showing a structure in which a circulating water spraying apparatus is installed in a gasket according to a third embodiment of the present invention.

FIG. 17 is a cross sectional view showing a structure in which a circulating water spraying apparatus 70(1) is installed in a gasket 60(3) according to a third embodiment of the present invention. Referring to FIG. 17, the circulating water spraying apparatus 70(1) may be configured such that the guide pipe 71 and the nozzles 73*a*, 73*b*(1), 73*b*(2), 73*c*(1), 73*c*(2) are integrated. The gasket 60(3) may include a cylindrical accommodating portion 640 protruded from the inner circumferential surface of the flat portion 64 and extending along the circumference.

A circulating water spraying apparatus 70(1) is accommodated inside the accommodating portion 640. An opening portion 69*h* is formed in the accommodating portion 640 at positions corresponding to the outlets of the respective nozzles 73*a*, 73*b*(1), 73*b*(2), 73*c*(1), and 73*c*(2) respectively, so that the circulating water is sprayed into the drum 40 through the opening 69*h*.

The circulating water spraying apparatus 70(1) may be embedded in the gasket 60(3). The circulating water spraying apparatus 70(1) and the gasket 60(3) may be integrally injected by an insert injection method. That is, after molding the circulating water spraying apparatus 70(1) which is a hard synthetic resin material, the circulating water spraying apparatus 70(1) is inserted into a mold for forming the gasket 60(3), and then the gasket 60(3) can be formed by injecting a soft resin between the water spraying apparatus 70(1) and the mold. In FIG. 17, 73*h*1 is the opening of the nozzle communicating with the guide pipe 71, and 73*h*2 is the outlet of the nozzle through which the circulating water is sprayed.

Since the guide pipe 71 is also installed during the manufacturing process of the gasket 60(3), there is an effect that the assembly number of the washing machine is reduced.

Since the guide pipe 71 is embedded in the gasket 60(3), even if the tub 31 vibrates, the circulating water spraying apparatus 70(1) is not easily detached from the gasket 60 (3), and furthermore, the guide pipe 71 is prevented from colliding with the structures (e.g., balancers 81, 82, 83) outside the tub 32.

Due to the water pressure transferred along the guide pipe (71) or the water pressure sprayed from the nozzles 73*a*, 73*b*(1), 73*b*(2), 73*c*(1), 73*c*(2), the guide pipe 71 is in close contact with the gasket 60(1) so that it is firmly fixed.

Figure 18:
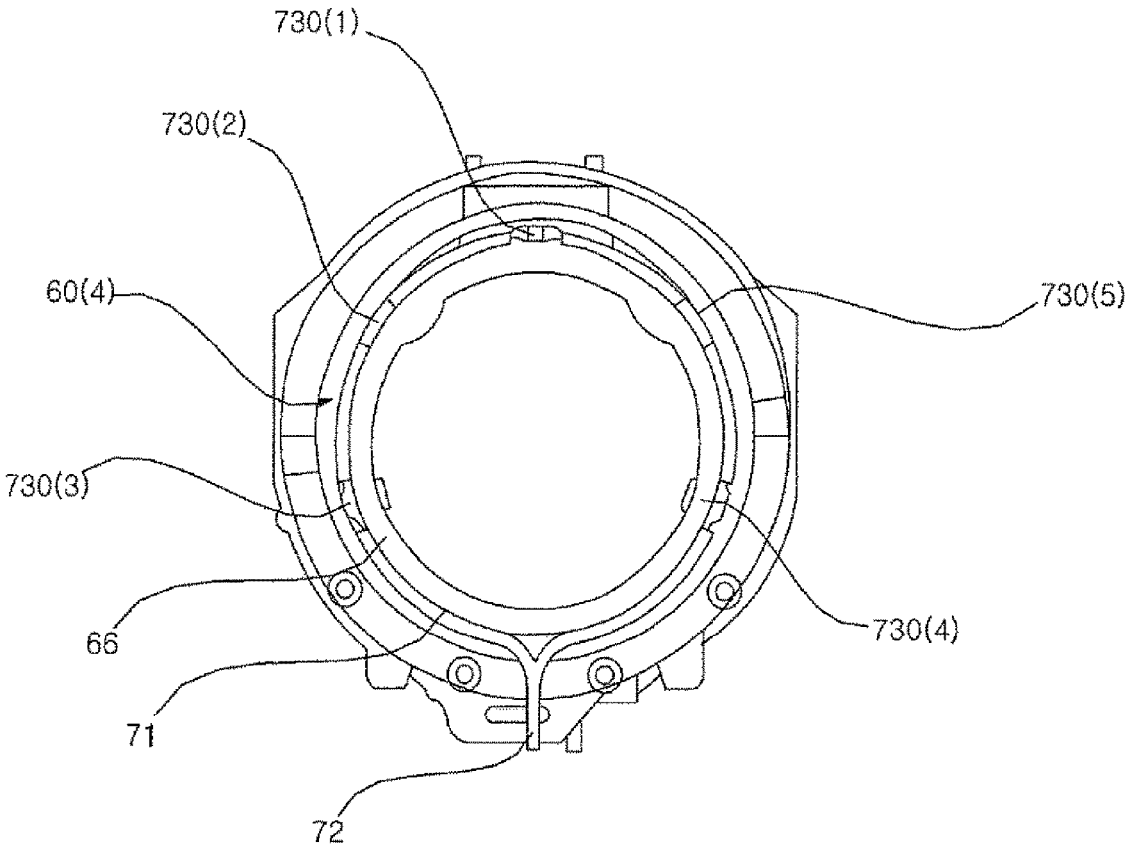
FIG. 18 shows an assembly of a gasket and a circulating water spraying apparatus according to a fourth embodiment of the present invention.
Figure 19:
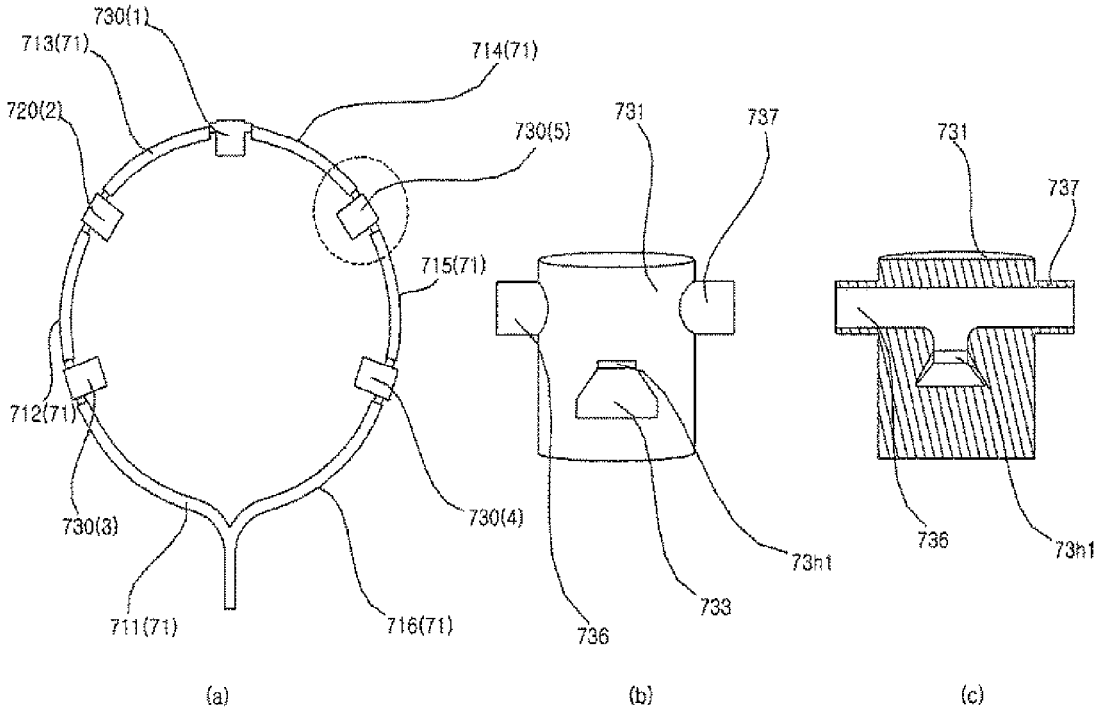
FIG. 19 shows the circulating water spraying apparatus shown in FIG. 18.
Figure 20:
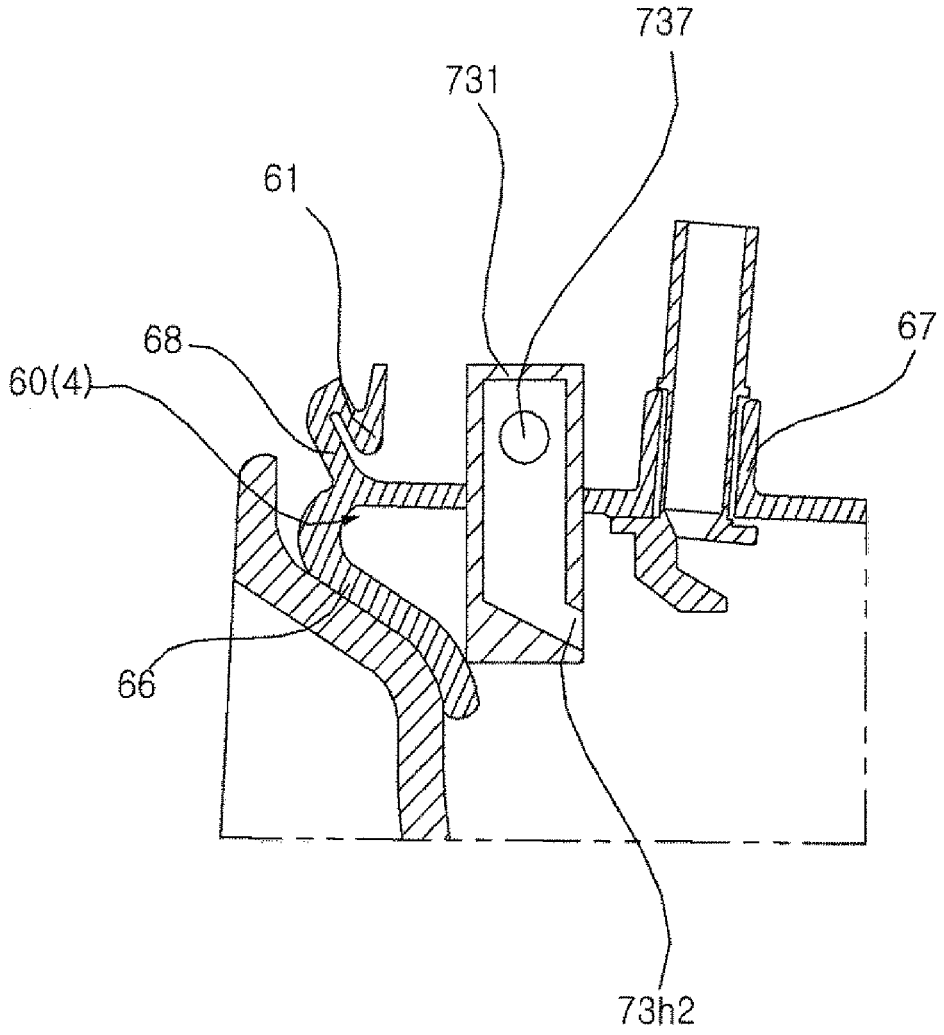
FIG. 20 is a cross-sectional view of an upper nozzle in a state where the circulating water spraying apparatus shown in FIG. 18 is installed in the gasket.

FIG. 18 shows an assembly of a gasket and a circulating water spraying apparatus according to a fourth embodiment of the present invention. FIG. 19 shows the circulating water spraying apparatus shown in FIG. 18. FIG. 20 is a cross-sectional view of an upper nozzle in a state where the circulating water spraying apparatus shown in FIG. 18 is installed in the gasket.

Referring to FIGS. 18 to 20, the circulating water spraying apparatus includes a guide pipe 71, an upper nozzle 730(1) supplied with water from the guide pipe 71, a pair of intermediate nozzles 730(2) and 730(5), and a pair of lower nozzles 730(3) and 730(4).

The guide pipe (71) is branched to both sides from the opening into which the circulating water flows and forms an annular flow path. The portion forming the annular flow path 71 is divided into a plurality of sections (711, 716), 712, 713, 714 and 715, and the nozzles 730(1), 730(2), 730(3), 730(4), and 730(5) are connected between adjacent sections.

The nozzles 730(1), 730(2), 730(3), 730(4), and 730(5) are provided with a connection pipe 736, 737 that is connected to the guide pipe 71 in both sides of a nozzle body 731 having an outlet 73*h*2 through which water is sprayed into the drum 40.

The guide pipe 71 is disposed outside the gasket 60(4). The nozzle body 731 is inserted and fixed in a through hole (not shown) formed in the gasket 60(4). In this state, the outlet 73*h*2 of the nozzle body 731 is positioned inside the gasket 60(4), and the connection pipe 736, 737 is positioned outside the gasket 60(4).

Figure 21:
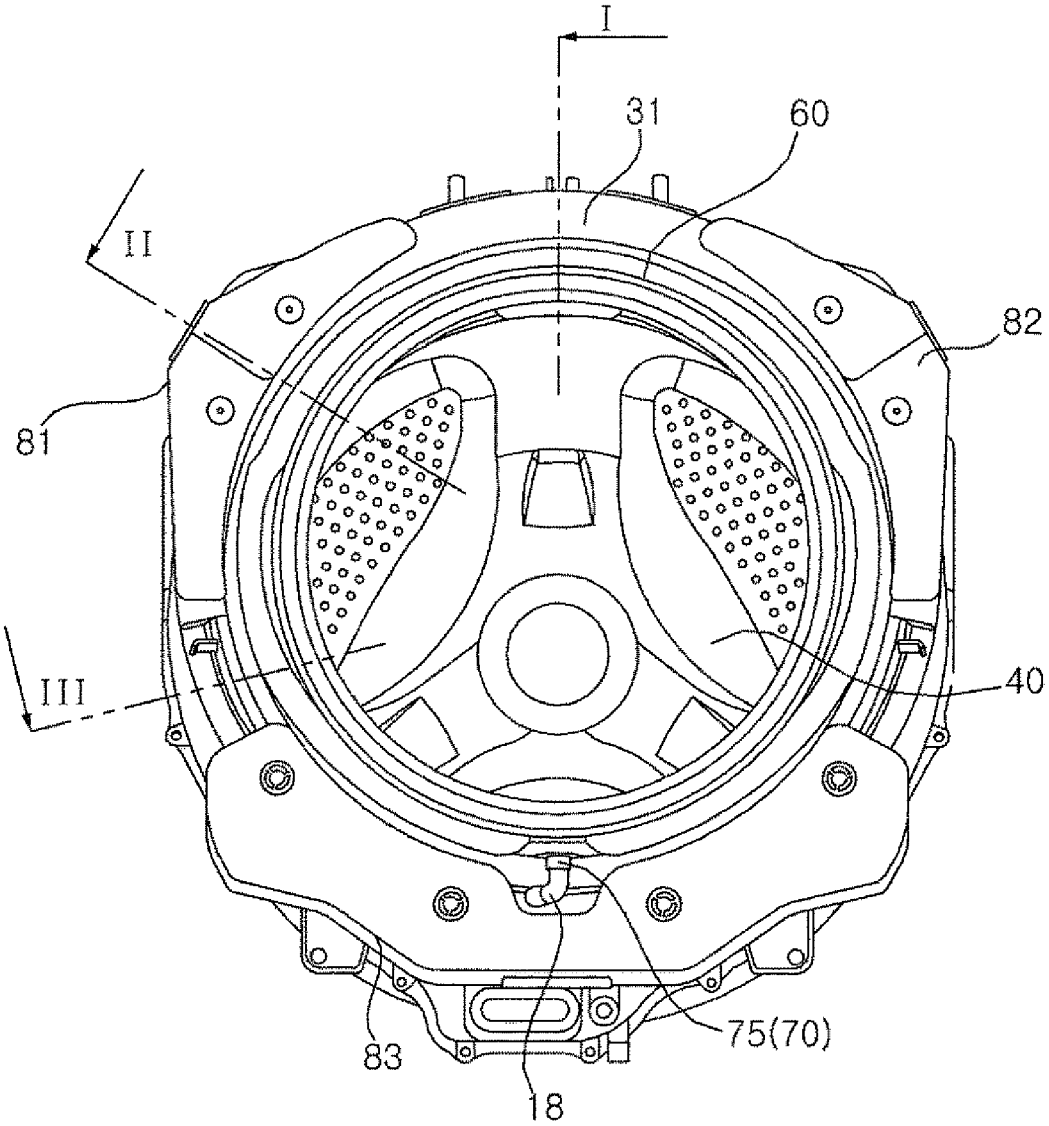
FIG. 21 illustrates a part of a washing machine according to another embodiment of the present invention.

FIG. 21 illustrates a part of a washing machine according to another embodiment of the present invention. Referring to FIG. 21, at least one balancer (81, 82, 83) may be provided on the front surface of the tub 31. The balancer 81, 82, 83 serves to reduce the vibration of the tub 31, and is a weight body having a certain weight. A plurality of balancers 81, 82, and 83 may be provided. A first upper balancer 81 and a second upper balancer 82 may be provided in the left and right sides on an upper portion of the front surface of the tub 31, and a lower balancer 83 may be provided on a lower portion of the front surface of the tub 31.

Figure 22:
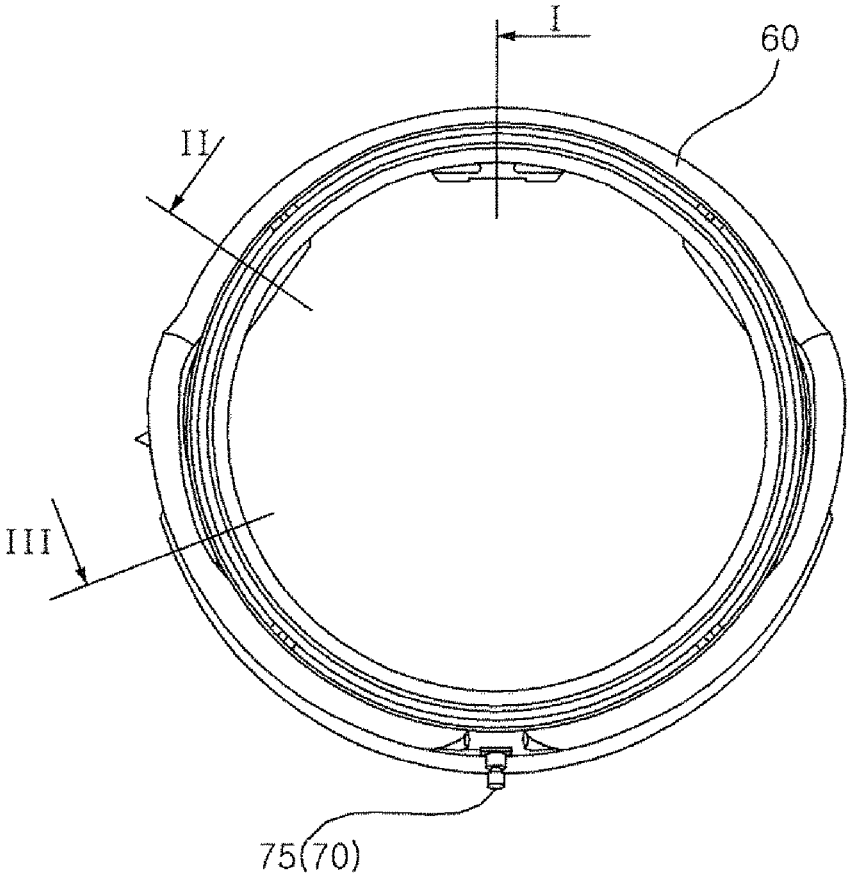
FIG. 22 is a front view of the assembly of the gasket and the guide pipe shown in FIG. 21.
Figure 23:
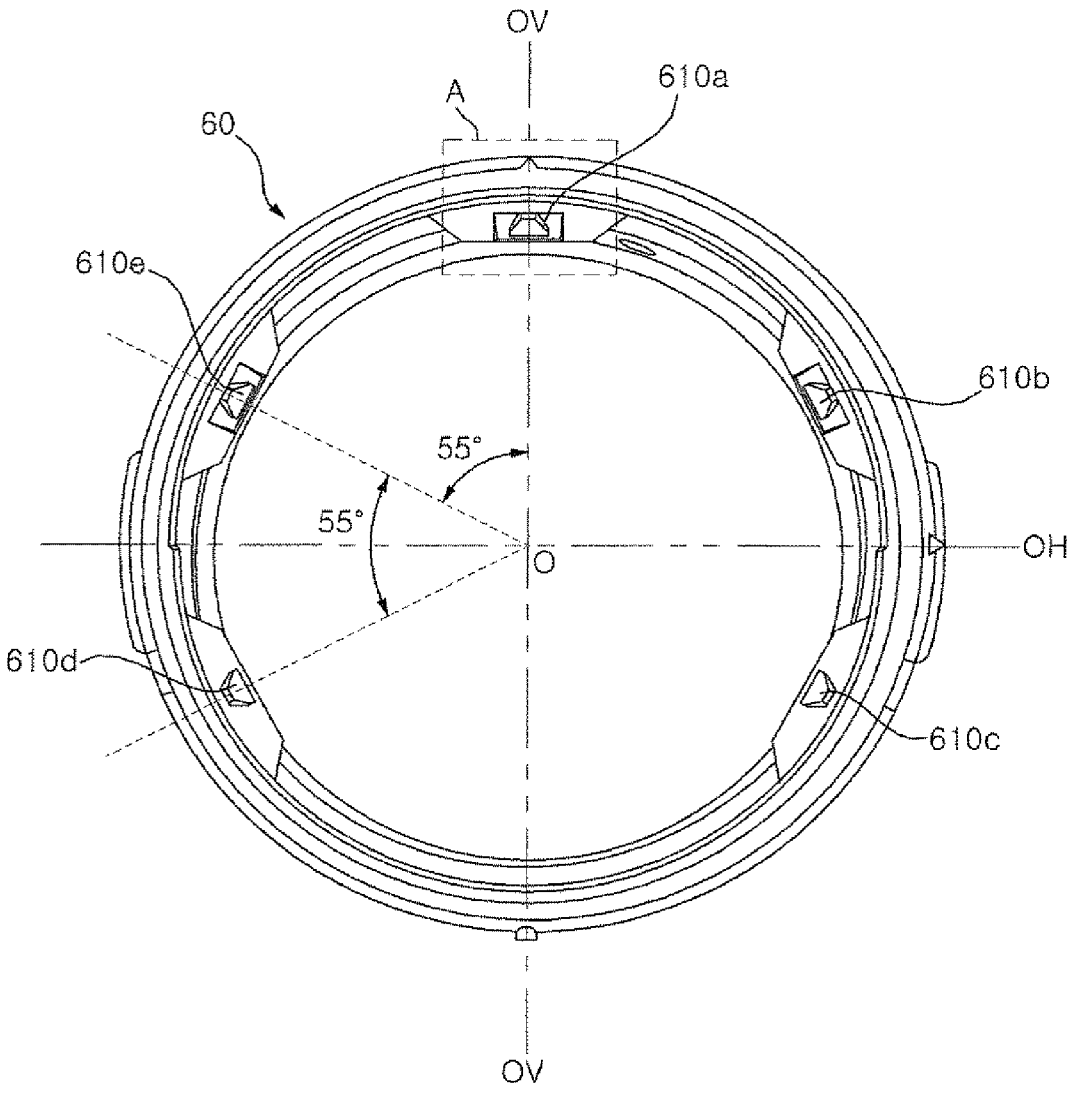
FIG. 23 is a rear view of the assembly shown in FIG. 22.
Figure 24:
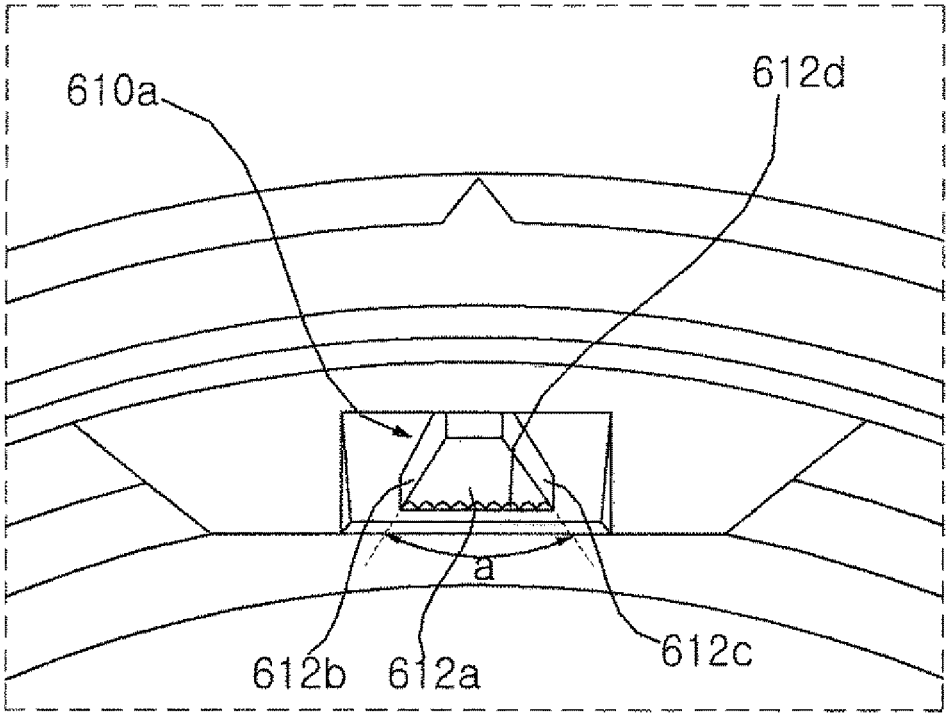
FIG. 24 is an enlarged view of a portion A in FIG. 23.
Figure 25:
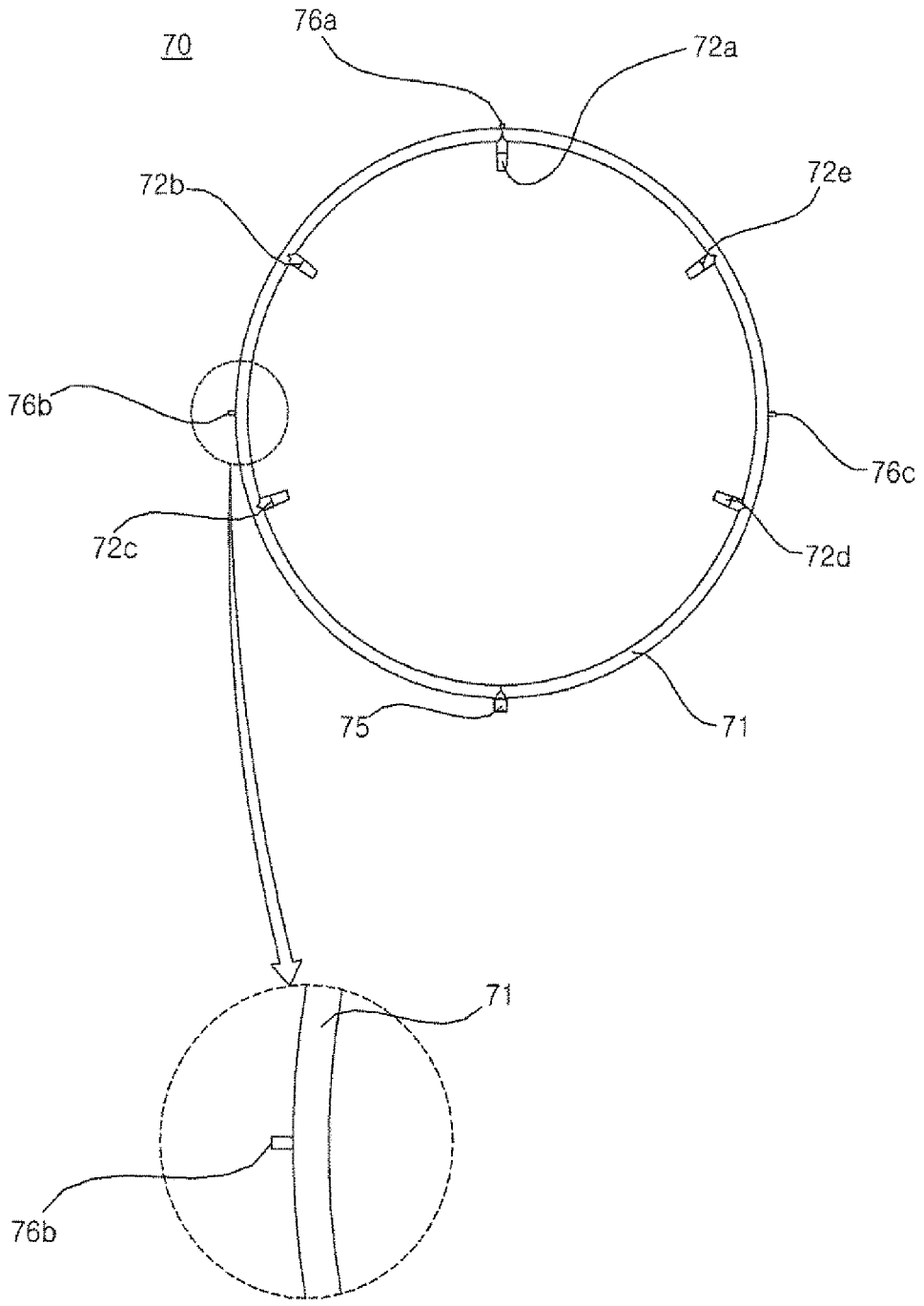
FIG. 25 is a front view of a guide pipe.
Figure 26:
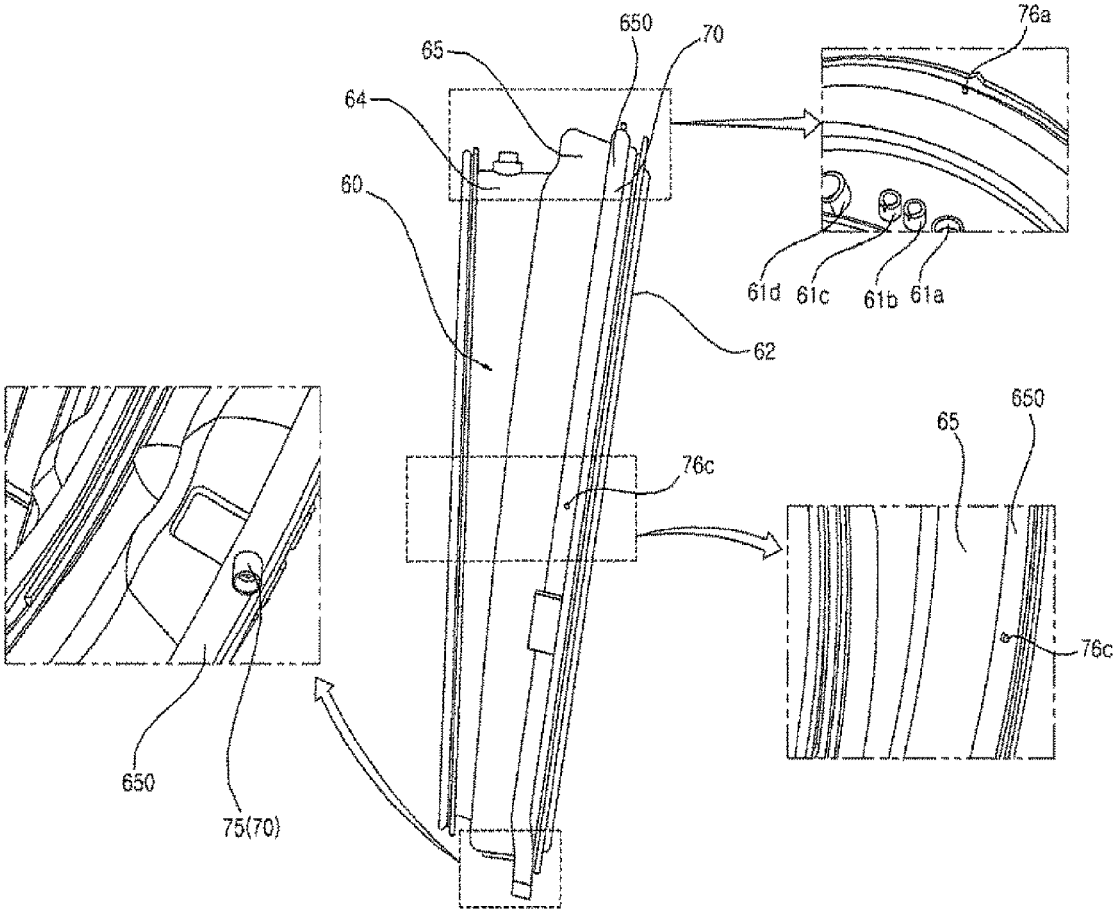
FIG. 26 is a right side view of the assembly shown in FIG. 22.
Figure 27:
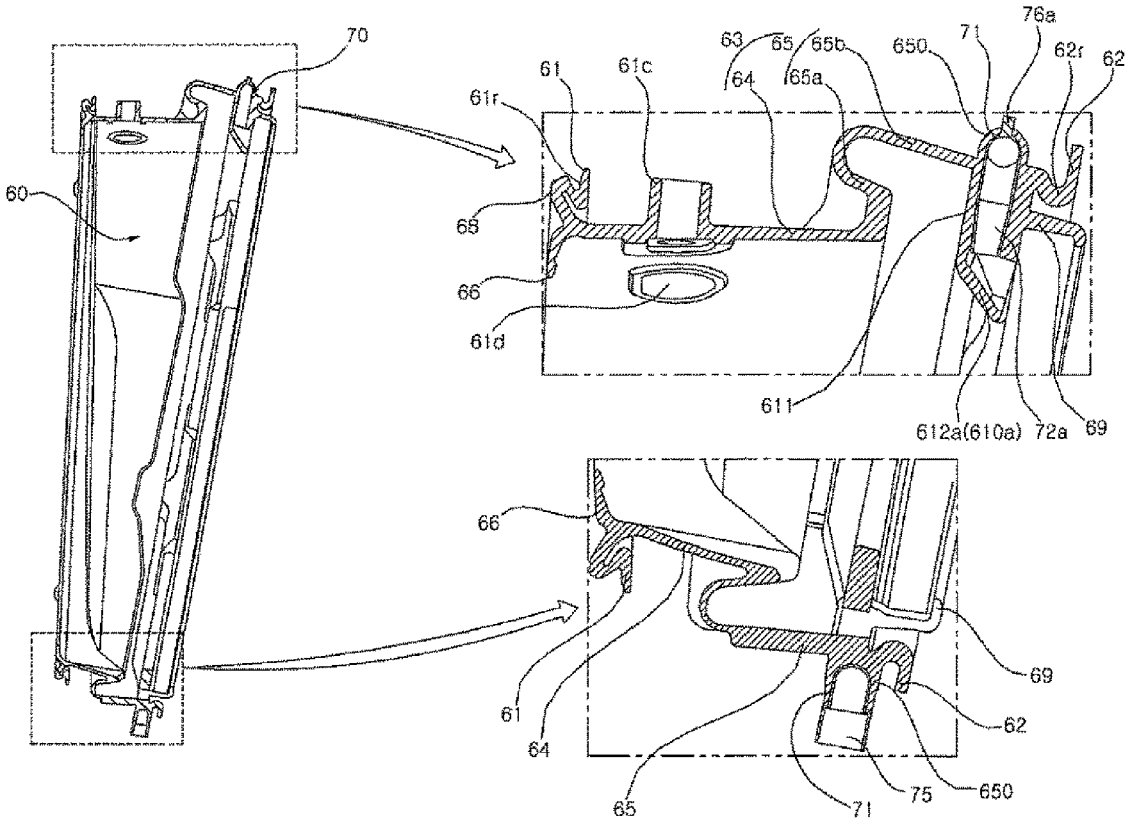
FIG. 27 is a cross-sectional view of FIG. 26.
Figure 28:
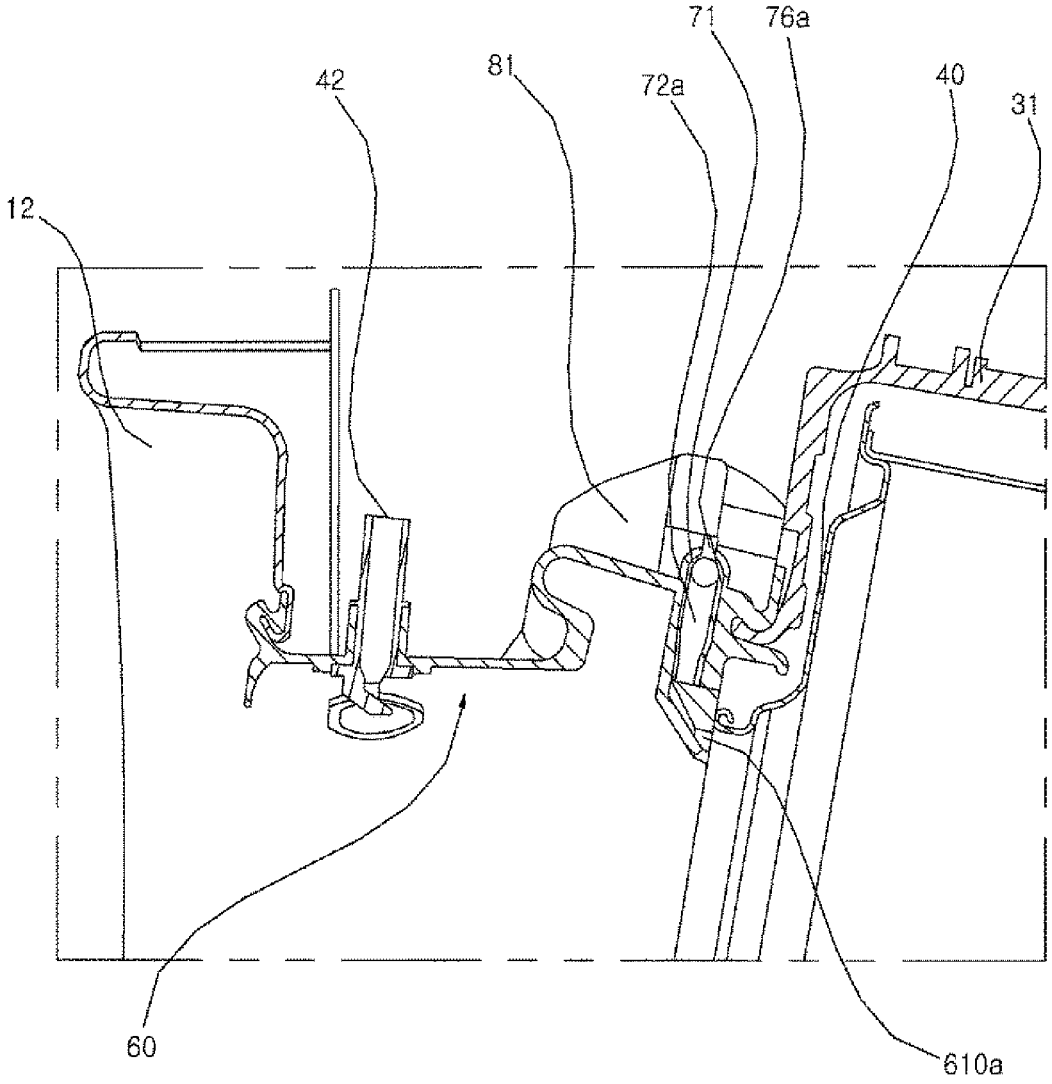
FIG. 28 is a cross-sectional view taken along the line I-I in FIG. 21.
Figure 29:
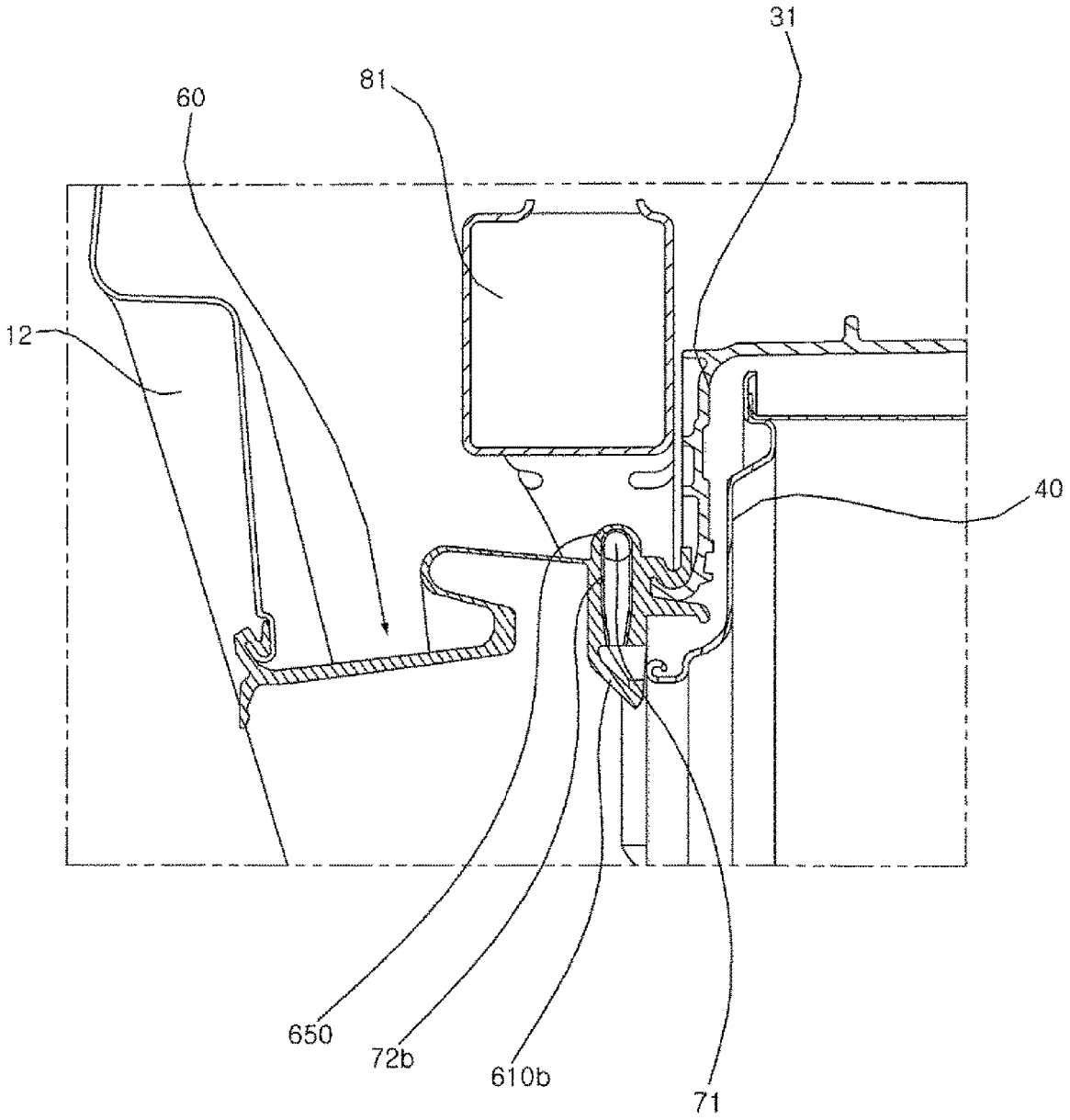
FIG. 29 is a cross-sectional view taken along line II-II in FIG. 21.
Figure 30:
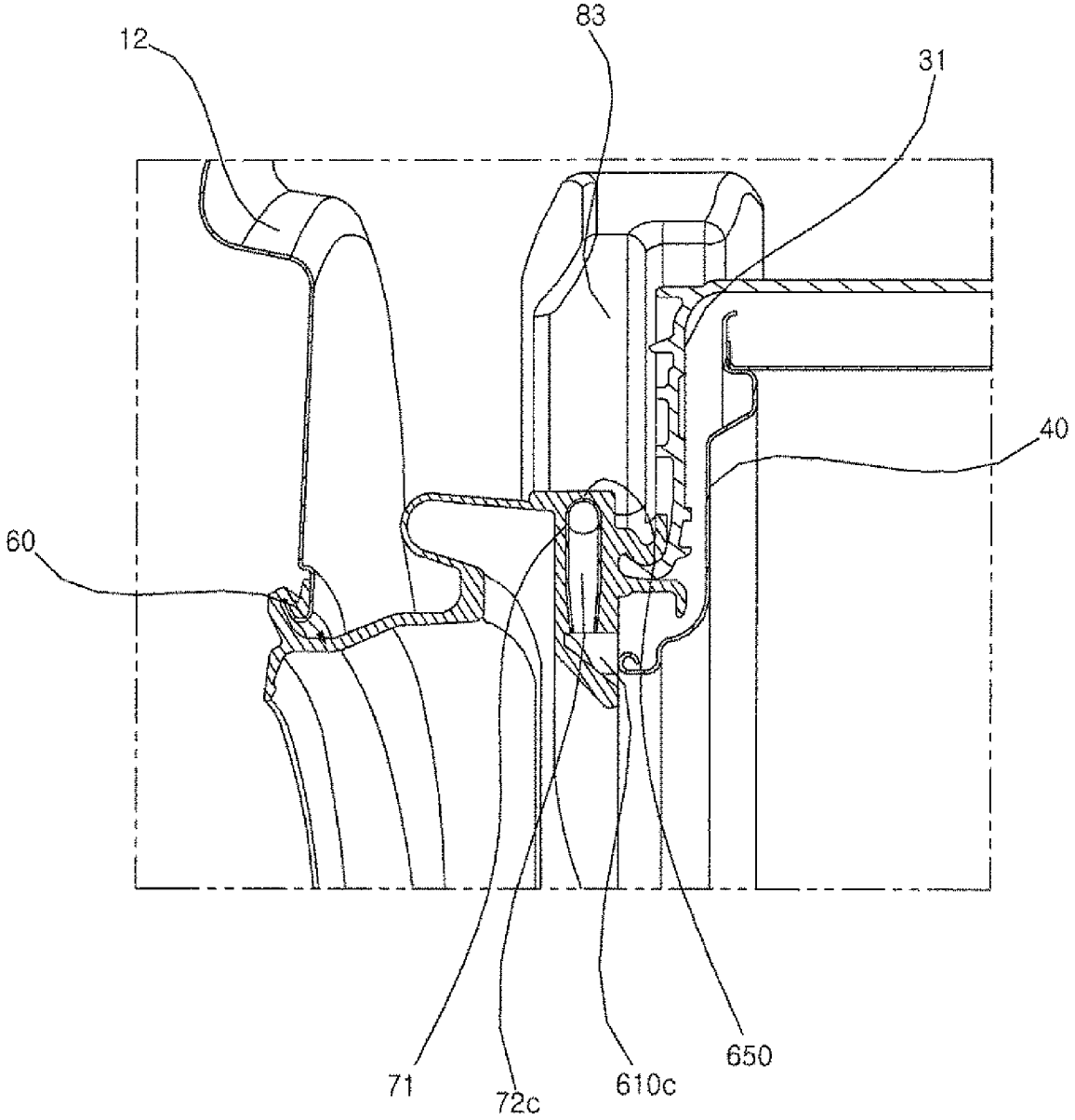
FIG. 30 is a cross-sectional view taken along line in FIG. 21.

FIG. 22 is a front view of the assembly of the gasket and the guide pipe shown in FIG. 21. FIG. 23 is a rear view of the assembly shown in FIG. 22. FIG. 24 is an enlarged view of a portion A in FIG. 23. FIG. 25 is a front view of a guide pipe. FIG. 26 is a right side view of the assembly shown in FIG. 22. FIG. 27 is a cross-sectional view of FIG. 26. FIG. 28 is a cross-sectional view taken along the line I-I in FIG. 21. FIG. 29 is a cross-sectional view taken along line II-II in FIG. 21. FIG. 30 is a cross-sectional view taken along line in FIG. 21.

Firstly, referring to FIG. 27, the gasket 60 may include a casing coupling unit 61 coupled to a circumference of the input port 12*h* of the casing 10, a tub coupling unit 62 coupled to a circumference of the opening of the tub 31, and an extension unit 63 extending between the casing coupling unit 61 and the tub coupling unit 62.

The casing coupling unit 61 and the tub coupling unit 62 are formed in an annular shape respectively, has an annular rear end portion connected to the tub coupling unit 62 from an annular front end portion connected to the casing coupling unit 61, and is formed in a cylindrical shape extending from the front end portion to the rear end portion.

In the front panel 12, a circumference of the input port 12*h* is curled outward, and the casing coupling unit 61 may be fitted in the concave portion formed by the curled portion (see FIGS. 28 to 30).

The casing coupling unit 61 may be provided with an annular groove 61*r* through which a wire is wound. After the wire is wound along the groove 61*r*, both ends of the wire are bound so that the casing coupling unit 61 is firmly fixed around the input port 12*h*.

In the tub 31, a circumference of the opening is curled outward, and the tub coupling unit 62 may be fitted into the concave portion formed by the curled portion (see FIGS. 28 to 30). The tub coupling unit 62 may be provided with an annular groove 62*r* through which a wire is wound. After the wire is wound along the groove 62*r*, both ends of the wire are engaged so that the tub coupling unit 62 is firmly coupled around the opening of the tub 31.

Meanwhile, the casing coupling unit 61 is fixed to the front panel 12, but the tub coupling unit 62 is displaced according to the movement of the tub 31. Therefore, the extension unit 63 should be able to be deformed in correspondence with the displacement of the tub coupling unit 62. In order to facilitate such deformation, the gasket 60 may be provided with a folded unit formed in a section (or the extension unit 63) between the casing coupling unit 61 and the tub coupling unit 62 such that the folded unit 65 is folded as the tub 31 is moved in the direction (or radial direction) in which the tub 31 is moved by eccentricity.

More specifically, the extension unit 63 may be provided with a flat portion 64 that extends evenly from the casing coupling unit 61 toward the tub coupling unit 62, and the folded unit 65 may be formed between the flat portion 64 and the tub coupling unit 62.

The gasket 60 may include an outer door close contact portion 68 which is bent outward from the front end of the flat portion 64 and is in close contact with the rear surface of the door 20 in the outside of the input port 12*h* in a state where the door 20 is closed. The casing coupling unit 61 may be provided with the groove 61*r* in a portion extending from the outer end of the outer door close contact portion 68.

The gasket 60 may include an inner door close contact portion 66 which is bent inward from the front end of the flat portion 64 and is in close contact with the rear surface (preferably, window 22) of the door 20 in the inside of the input port 12*h* in a state where the door 20 is closed.

Meanwhile, the drum 40 is vibrated (i.e., the rotation center line C of the drum 40 moves) during the rotation process, and thus, the center line of the tub 31 (approximately, the same as the rotation center line C of the drum 40) is also moved. At this time, the moving direction (hereinafter, referred to as "eccentric direction") has a radial component.

The folded unit 65 is folded or unfolded when the tub 31 moves in the eccentric direction. The folded unit 65 may include an inner diameter portion 65*a* which is bent from the flat portion toward the casing coupling unit 61, and an outer diameter portion 65*b* which is bent from the inner diameter portion 65*a* toward the tub coupling unit 62 side and connected to the tub coupling unit 62. When the center of the tub 31 is moved in the eccentric direction, if a part of the folded unit 65 is folded, a gap between the inner diameter portion 65*a* and the outer diameter portion 65*b* is reduced at the portion of the folded unit 65. On the other hand, in the other portion where the folded unit 65 is unfolded, a gap between the inner diameter portion 65*a* and the outer diameter portion 65*b* is widened.

Meanwhile, the gasket 60 may further include an annular protrusion 69 protruded from the outer diameter portion 65*b*. The protrusion 69 has a smaller diameter than the tub coupling unit 62.

The gasket 60 includes a plurality of nozzles 610*a*, 610*b*, 610*c*, 610*d*, and 610*e* for spraying circulating water into drum 40. The guide pipe 70 guides the circulating water sent by the pump 36 to the plurality of nozzles 610*a*, 610*b*, 610*c*, 610*d* and 610*e*, and is fixed to the gasket 60.

The guide pipe 70 includes an annular flow path 71 (or a flow pipe) for guiding water supplied through the circulation pipe 18 and a plurality of nozzle water supply ports 72*a*, 72*b*, 72*c*, 72*d*, 72*e* protruded from the annular flow path 71. Each of the nozzle water supply ports 72*a*, 72*b*, 72*c*, 72*d*, 72*e* is protruded inward along the radial direction from the annular flow path 71, and is connected to a plurality of nozzles 610*a*, 610*b*, 610*c*, 610*d*, 610*e*.

In addition, the guide pipe 70 may include a circulation pipe connection port 75 that is protruded from the annular flow path 71 and is connected to the circulation pipe 18. The circulation pipe connection port 75 is protruded outward along the radial direction from the annular flow path 71, and may be connected to the circulation pipe 18 through the gasket 60.

The extension unit 63 of the gasket 60 may be provided with a guide pipe accommodating unit 650 in which the annular flow path 71 is accommodated. The guide pipe accommodating unit 650 may be protruded outward from the extension unit 63 along the radial direction. The guide pipe accommodating unit 650 may be formed in a cylindrical shape extending annularly along the circumference of the extension unit 63 and surrounding the annular flow path 71 disposed inside. The guide pipe accommodating unit 650 may be protruded from the outer diameter portion 65*b* of the folded unit 65.

Port through holes communicating with the guide pipe accommodating unit 650 may be formed on the inner circumferential surface of the extension unit 63 of the gasket 60, in correspondence with the plurality of nozzle water supply ports 72*a*, 72*b*, 72*c*, 72*d*, 72*e*. In addition, the gasket 60 may include a plurality of port insertion pipes 611 (see FIG. 27) protruded inwardly along the radial direction from the extension unit 63. The port through hole is formed in one end of each port insertion pipe 611, and the other end is connected to a corresponding nozzle 610*a*, 610*b*, 610*c*, 610*d*, 610*e*. A plurality of nozzle water supply ports 72*a*, 72*b*, 72*c*, 72*d*, and 72*e* are inserted into corresponding port insertion pipes 611, respectively.

The gasket 60 and the guide pipe 70 may be integrally formed by insert injection molding. That is, after the guide pipe 70 of a synthetic resin material is molded, the guide pipe 70 thus formed is inserted into a mold provided to form the gasket 60. Then, molding material for forming the gasket 60 is injected into a cavity between the guide pipe 70 and the mold and then hardened so that the gasket 60 and the guide pipe 70 are integrally formed.

Meanwhile, the guide pipe 70 may further include a fixing pin 76*a*, 76*b*, 76*c* protruded outward along the radial direction from the outer circumferential surface of the annular flow path 71. The fixing pin 76*a*, 76*b*, 76*c* serves to fix the guide pipe 70 in the mold during the above-described insert injection molding. A groove to which the fixing pin 76*a*, 76*b*, 76*c* is inserted and fixed, or a fastener for fastening the fixing pin may be formed in the mold. After fixing the guide pin 70 by inserting the fixing pin 76*a*, 76*b*, 76*c* into the groove, the molding material is injected into the mold. The fixing pin 76*a*, 76*b*, 76*c* is protruded to the outside of the gasket 60 in the moldings (i.e., the assembly in which the gasket 60 and the guide pipe 70 are integrally formed) injected by the above mentioned method (see FIG. 26).

A plurality of the fixing pins 76*a*, 76*b*, and 76*c* may be protruded from the annular flow path 71. In an embodiment, although the fixing pins 76*a*, 76*b*, and 76*c* are formed in the upper end (in the 12 o'clock position), the left end (in the 9 o'clock position), and the right end (in the 3 o'clock position) of the annular flow path 71 respectively, but is not limited thereto, and the position and the number can be determined appropriately according to the mold.

Meanwhile, the plurality of nozzles 610*a*, 610*b*, 610*c*, 610*d*, and 610*e* spray the circulating water supplied through corresponding nozzle water supply ports 72*a*, 72*b*, 72*c*, 72*d*, and 72*e* into the drum 40, respectively.

The plurality of nozzles 610*a*, 610*b*, 610*c*, 610*d*, and 610*e* may include an upper nozzle 610*a* for spraying the circulating water downward, a pair of intermediate nozzles 610*b* and 610*e* which are disposed below the upper nozzle 610*a* and spray the circulating water downward while spraying deeper into the drum 40 than the upper nozzle 610*a*, a pair of lower nozzles 610*c* and 610*d* which are disposed below the pair of intermediate nozzles 610*b* and 610*e* and spray the circulating water upward.

Hereinafter, the configuration of the upper nozzle 610*a* described with reference to FIGS. 23, 24, and 27 may be identically applied to the other nozzles 610*b*, 610*c*, 610*d*, and 610*e*.

Referring to FIGS. 23, 24 and 27, the gasket 60 may include a port insertion pipe 611 into which the nozzle water supply port 72*a*, 72*b*, 72*c*, 72*d*, 72*d*, and 72*e* is inserted inward. As in the embodiment, the port insertion pipe 611 is protruded from the inner circumferential surface of the outer diameter portion 65*b*, when the guide pipe accommodating unit 650 is formed on the outer diameter portion 65*b* of the folded unit 65.

Specifically, the port insertion pipe 611 has a cylindrical shape, and may be protruded from the inner circumferential surface of the outer diameter portion 65*b*. One end of the port insertion pipe 611 is in communication with the guide pipe accommodating unit 650 and the other end thereof is connected to corresponding nozzle 610*a*, 610*b*, 610*c*, 610*d*, 610*e*. The nozzle water supply port 72*a*, 71*b*, 72*c*, 72*d*, 72*d*, 72*e* may be inserted into the plurality of port insertion pipes 611, respectively.

The upper nozzle 610*a* may include a collision surface 612*a* with which the water sprayed from the nozzle water supply port 72*a* collides, and a left side surface 612*b*, and a right side surface 612*c* which extend from the left side and the right side of the collision surface 612*a* and define the left and right boundaries of the water current that flows along the collision surface 612*a*.

The angle ($\alpha$) formed by the left side surface 612*b* and the right side surface 612*c* of the upper nozzle 610*a* is approximately degrees to 60 degrees, preferably 55 degrees, but is not necessarily limited thereto.

A plurality of protrusions 612*d* may be arranged in the lateral direction (or in the width direction of the water current) in the end of the collision surface 612*a*, which is the outlet of the upper nozzle 610*a*, or in the vicinity of the outlet. The water current progressing along the collision surface 612*a* collides with the protrusion 612*d*, and then is sprayed through the outlet. As for the water current sprayed through the upper nozzle 610*a*, the water current portion that is sprayed after passing through the protrusions 612*d* is thick, whereas the water current portion that is sprayed after climbing over the protrusion 612*d* is formed to be relatively thin. Thus, a thin water film is spread out between the thick main streams.

Meanwhile, the circulation pipe connection port 75 is connected to the annular flow path 71 below any one of the plurality of nozzles 610*a*, 610*b*, 610*c*, 610*d*, and 610*e*. Preferably, the circulation pipe connection port 75 is connected to the lowermost point of the annular flow path 71.

That is, in the annular flow path 71, the inflow port 71*h* through which the water currents introduced from the circulation pipe connection port 75 may be positioned in the lowermost point. The pair of intermediate nozzles 610*b* and 610*e* are formed above the inflow port 71*h* and may be disposed in the left and right sides respectively based on the inflow port 71*h*. The pair of intermediate nozzles 610*b* and 610*e* are disposed symmetrically with respect to the vertical line OV passing through the center O of the annular flow path 71 (see FIG. 23). Thus, the spraying direction of the respective intermediate nozzles 610*b* and 610*e* are also symmetrical with respect to the vertical line (OV).

The pair of intermediate nozzles 610*b* and 610*e* may be positioned above the center O of the guide pipe 77 (note that the OH shown in FIG. 23 is a horizontal line passing through the center O). Since the intermediate nozzles 610*b* and 610*e* spray the circulating water downward, when the drum 40 is viewed from the front, the circulating water passes through the area above the center C of the drum 40 in the opening side of the drum 40, and is sprayed into the drum 40 in a downward inclined manner as it progresses deeply inward.

The pair of lower nozzles 610*c* and 610*d* are disposed above the inflow port 71*h*, but below the pair of intermediate nozzles 610*b* and 610*e*. The pair of lower nozzles 610*c* and 610*d* may be disposed in the left and right sides based on the inflow port 71*h*, and preferably, disposed symmetrically with respect to the vertical line OV so that the spraying direction of the respective lower nozzles 610*c*, 610*d* are symmetrical with respect to the vertical line OV.

The pair of lower nozzles 610*c* and 610*d* may be positioned below the center O of the guide pipe 70. Since the respective lower nozzles 610*c* and 610*d* spray the circulating water upward, when the drum 40 is viewed from the front, the circulating water passes through the area below the center C of the drum 40 in the opening side of the drum 40, and is sprayed into the drum 40 in a upward inclined manner as it progresses deeply inward.

The upper nozzle 610*a* is preferably disposed on a vertical line OV, and the shape of the circulating water sprayed through the upper nozzle 610*a* is symmetrical with respect to the vertical line OV.

The circulating water supplied through the circulation pipe flows into the guide pipe 71 through the circulation pipe connection port 75 and then is branched to both sides and rises along the flow path, and is sprayed sequentially from the nozzles positioned below. The operating pressure of the pump 36 may be controlled to such an extent that the sent water can reach the upper nozzle 610*a*.

Meanwhile, the controller can vary the spraying pressure of the nozzles 610*a*, 610*b*, 610*c*, 610*d*, and 610*e* by controlling the speed of the pump motor. As one embodiment of such a spraying pressure control, the speed of the pump motor can be variably controlled within a range in which spraying is simultaneously performed by all of the nozzles 610*a*, 610*b*, 610*c*, 610*d*, and 610*e*. When the circulating water is sprayed by the nozzles 610*a*, 610*b*, 610*c*, 610*d*, and 610*e*, a filtration motion in which the laundry is rotated together with the drum 40 while the laundry is adhered to the inner surface of the drum 40 may be performed.

The filtration motion may be performed a plurality of times. The acceleration of the pump motor can be synchronized with the execution timing of each filtration motion, and the deceleration can be synchronized with the timing of braking the drum 40 for the termination of each filtration motion.

That is, when the drum 40 starts to accelerate for the filtration motion, the pump motor is also accelerated so that the spraying pressure through the nozzle 610*a*, 610*b*, 610*c*, 610*d* and 610*e* can be maximized when (a state where the centrifugal force is larger than the gravity so that the laundry does not fall even when the laundry reaches the peak due to the rotation of the drum 40) the laundry is completely adhered to the drum 40 and rotated together with the drum 40. When the rotation speed of the pump motor is maximized while the filtration motion is being performed, the circulating water sprayed from the nozzles 610*a*, 610*b*, 610*c*, 610*d*, and 610*e* reaches deepest into the drum 40. Particularly, the circulating water sprayed through the intermediate nozzle 610*b* and 610*e* can reach the deepest portion of the drum 40 in comparison with other nozzles 610*a*, 610*c*, and 610*d*.

Referring to FIG. 23, with respect to the center O of the guide pipe 71 (or the center of the gasket 60), when the intermediate nozzle 610*b*, 610*e* forms an angle θ1 with the upper nozzle 610*a* and when the lower nozzle 610*c*, 610*d* forms an angle θ2 with the intermediate nozzle 610*b*, 610*e*, θ1 may be approximately 50 degrees to 60 degrees, and preferably 55 degrees as shown in FIG. 5, but not necessarily limited thereto.

The gasket 60 may be provided with a direct water nozzle 42 (see FIG. 28). The direct water nozzle 42 sprays water (i.e., direct water) supplied from an external water source (e.g., a faucet) into the drum 40. The flat portion 64 of the gasket 60 may be provided with a first installation pipe 61*c* (see FIGS. 26 and 27) in which the direct water nozzle 42 is installed.

The gasket 60 may be provided with a steam spraying nozzle (not shown). The washing machine according to an embodiment of the present invention may include a steam generator (not shown) for generating steam. The steam nozzle sprays steam generated by the steam generator into the drum 40. The flat portion 64 of the gasket 60 may be provided with a second installation pipe 61*d* (see FIGS. 26 and 27) in which the steam nozzle is installed. Meanwhile, contrary to the embodiment, it is also possible that the steam nozzle is installed in the first installation pipe 61*c* and the direct water nozzle 42 is installed in the second installation pipe 61*d*.

Meanwhile, the ports 61*a* and 61*b* shown in FIG. 26, which are not described above, are provided for installing the nozzles provided according to the specifications of the washing machine. The above mentioned nozzle may be the direct water nozzle 42 or the steam nozzle, or a separate nozzle may be further provided.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

The invention claimed is:

1. A washing machine comprising:

a casing having an input port defined at a front surface of the casing, the input port being configured to receive laundry;

a tub disposed in the casing and configured to receive washing water, the tub having a tub opening that is defined at a front surface of the tub and that is in communication with the input port;

a drum rotatably disposed in the tub and configured to accommodate the laundry;

a cylindrical gasket that communicates the input port with the tub opening;

a pump configured to circulate water that is discharged from the tub;

a guide pipe that is fixed to the gasket and that defines an annular flow path configured to guide water supplied from the pump, the guide pipe having an inflow port configured to receive the water supplied from the pump; and a plurality of nozzles configured to spray, into the drum, the water supplied from the pump through the guide pipe, wherein the plurality of nozzles comprise:

an upper nozzle configured to spray downward the water supplied from the pump, a pair of intermediate nozzles that are disposed below the upper nozzle, that are respectively disposed in left and right sides with respect to the inflow port of the guide pipe, and that are configured to spray downward the water supplied from the pump, the pair of intermediate nozzles being configured to spray the water supplied from the pump deeper into the drum than the upper nozzle, and a pair of lower nozzles that are disposed above the inflow port, disposed and below the pair of intermediate nozzles, that are disposed in both left and right sides with respect to the inflow port, and that are configured to spray upward the water supplied from the pump.

2. The washing machine of claim 1, wherein the guide pipe is fixed to an inner circumferential surface of the gasket, and wherein the plurality of nozzles are integrally formed with the guide pipe.

3. The washing machine of claim 2, wherein the gasket comprises:

a casing coupling unit coupled to a circumference of the input port;

a tub coupling unit coupled to a circumference of the tub opening;

a flat portion extending evenly from the casing coupling unit toward the tub coupling unit; and a folded unit that is disposed between the flat portion and the tub coupling unit, and that is folded in correspondence with displacement of the tub, and wherein the guide pipe is disposed in the flat portion.

4. The washing machine of claim 3, wherein the gasket protrudes outward from the flat portion, the flat portion defining an accommodating groove on an inner circumferential surface of the flat portion, and wherein at least a part of the guide pipe is accommodated in the accommodating groove.

5. The washing machine of claim 4, further comprising a connection pipe that extends outwardly from the inflow port of the guide pipe and pass through the gasket and connected to a circulation pipe for guiding water sent by the pump in the outside of the gasket, wherein the accommodating groove is formed in an upper area excluding a certain lower area defined by including a point through which the connection pipe passes.

6. The washing machine of claim 3, wherein the gasket further comprises a cylindrical accommodating portion that protrudes from the inner circumferential surface of the flat portion and that extends along a circumference of the gasket, and wherein at least a part of the guide pipe is accommodated in the accommodating portion.

7. The washing machine of claim 6, wherein the guide pipe and the accommodating portion are integrally formed by insert injection.

8. The washing machine of claim 1, wherein the guide pipe is fixed on an outer circumferential surface of the gasket, and wherein the plurality of nozzles are disposed to penetrate the gasket, and are connected to the guide pipe in the outside of the gasket.

9. The washing machine of claim 1, wherein the pair of intermediate nozzles are disposed above a center of the guide pipe.

10. The washing machine of claim 9, wherein the pair of intermediate nozzles are symmetrically formed.

11. The washing machine of claim 1, wherein the pair of lower nozzles are disposed below a center of the guide pipe.

12. The washing machine of claim 11, wherein the pair of lower nozzles are symmetrically formed.

13. The washing machine of claim 1, wherein each of the plurality of nozzles comprises:

an opening forming surface having an opening through which water is introduced through the guide pipe; and a collision surface for guiding the water that is discharged through the opening to progress to an outlet that is opened toward the drum, after the water collides with the collision surface, and wherein an angle formed by the opening forming surface and the collision surface becomes smaller in order of the upper nozzle, the intermediate nozzle, and the lower nozzle.

14. The washing machine of claim 1, wherein the inflow port is disposed in a lowermost point of the guide pipe.

15. The washing machine of claim 1, wherein the plurality of nozzles are integrally formed with the guide pipe.

16. The washing machine of claim 1, wherein the pump is able to accomplish a speed control.

17. The washing machine of claim 1, wherein the plurality of nozzles are formed in the gasket, and wherein the guide pipe is embedded in the gasket.

18. The washing machine of claim 17, wherein the gasket comprises:

a casing coupling unit coupled to a circumference of the input port of the casing;

a tub coupling unit coupled to a circumference of the tub opening;

an extension unit extending from between the casing coupling unit and the tub coupling unit; and a guide pipe accommodating unit that protrudes outwardly from the extension unit and that accommodates the guide pipe therein.

19. The washing machine of claim 18, wherein the extension unit comprises:

a flat portion extending evenly from the casing coupling unit toward the tub coupling unit; and a folded unit that is disposed between the flat portion and the tub coupling unit and that is folded in correspondence with displacement of the tub, wherein the folded unit comprises:

an inner diameter portion bent from the flat portion toward the casing coupling unit; and an outer diameter portion bent from the inner diameter portion toward the tub coupling unit, and wherein the guide pipe accommodating unit is formed in the outer diameter portion.

20. The washing machine of claim 19, wherein the guide pipe comprises a plurality of nozzle water supply ports that protrude inwardly along a radial direction from the annular flow path, in correspondence with the plurality of nozzles respectively, and wherein, in the gasket, a plurality of port insertion pipes that protrude from an inner circumferential surface of the outer diameter portion, have one end communicating with the guide pipe accommodating unit, and have the other end connected with a corresponding nozzle are formed, and the nozzle water supply port is inserted into each of the port insertion pipes.

21. The washing machine of claim 20, further comprising a circulation pipe for guiding water sent by the pump, wherein the guide pipe further comprises a circulation pipe connection port that has one end defining the inflow port, the circulation pipe connection port protruding from the one end, passing through the gasket, and being connected to the circulation pipe.

22. The washing machine of claim 17, wherein the guide pipe further comprises at least one fixing pin that protrudes from an outer circumferential surface of the annular flow path, that passes through the gasket, and that protrudes outside of the gasket.

23. The washing machine of claim 22, wherein the at least one fixing pin is formed in an upper end, a left end, and a right end of the annular flow path respectively.

24. The washing machine of claim 17, wherein the pair of intermediate nozzles are disposed above a center of the annular flow path.

25. The washing machine of claim 24, wherein the pair of intermediate nozzles are symmetrically formed.

26. The washing machine of claim 17, wherein the pair of lower nozzles are disposed below a center of the annular flow path.

27. The washing machine of claim 26, wherein the pair of lower nozzles are symmetrically formed.

28. The washing machine of claim 17, wherein each of the plurality of nozzles comprises:

a collision surface configured to collide with and guide the water discharged from the guide pipe to an outlet of the nozzle that is opened toward the drum.

29. The washing machine of claim 17, wherein the inflow port is connected to a lowermost point of the annular flow path.

30. The washing machine of claim 17, wherein the pump is able to accomplish a speed control.

31. The washing machine of claim 17, wherein the guide pipe and the gasket are integrally formed by insert molding.

* * * * *